US012433406B2

(12) United States Patent
Sun et al.

(10) Patent No.: US 12,433,406 B2
(45) Date of Patent: Oct. 7, 2025

(54) STOWAWAY COMPACT ROCKER

(71) Applicant: GCI OUTDOOR LLC, Higganum, CT (US)

(72) Inventors: Jim Sun, Rancho Palos Verdes, CA (US); Bruce Agli, East Hampton, CT (US)

(73) Assignee: GCI Outdoor LLC, Higganum, CT (US)

( * ) Notice: Subject to any disclaimer, the term of this patent is extended or adjusted under 35 U.S.C. 154(b) by 229 days.

(21) Appl. No.: 18/478,432

(22) Filed: Sep. 29, 2023

(65) Prior Publication Data

US 2024/0016295 A1 Jan. 18, 2024

Related U.S. Application Data

(63) Continuation-in-part of application No. 17/648,088, filed on Jan. 14, 2022, now Pat. No. 11,969,102.
(Continued)

(51) Int. Cl.
*A47C 3/025* (2006.01)
*A47C 4/02* (2006.01)

(52) U.S. Cl.
CPC ..... *A47C 3/0252* (2013.01); *A47C 4/021* (2013.01); *A47C 4/022* (2013.01); *A47C 4/028* (2013.01)

(58) Field of Classification Search
CPC ..... A47C 3/0255; A47C 4/021; A47C 4/03; A47C 4/28; A47C 4/42; A47C 7/44;
(Continued)

(56) References Cited

U.S. PATENT DOCUMENTS 1,440,248 A * 12/1922 Shoemaker ..... A47C 4/42 297/51
1,969,313 A 8/1934 Meeker
(Continued)

FOREIGN PATENT DOCUMENTS

CN 201064295 Y 5/2008
CN 201286493 Y 8/2009
(Continued)

OTHER PUBLICATIONS

PCT Application No. PCT/US2023/075862, International Search Report and Written Opinion dated Jan. 24, 2024.
(Continued)

*Primary Examiner* — Robert Canfield
(74) *Attorney, Agent, or Firm* — Lathrop GPM LLP; Wm. Tucker Griffith

(57) ABSTRACT

A stowaway compact rocker having a set-up condition and a collapsed condition comprises a stationary chair frame base; a movable chair frame seating assembly adapted for rocking movement relative to the stationary chair frame base; and a rocker mechanism operatively connected between the stationary chair frame base and the movable chair frame seating assembly. The stationary chair frame base comprises a lower transverse support member, a pair of leg mounts disposed thereon, front leg tubes, and rear legs tubes, each leg tube being adapted for connection to a leg mount. The movable chair frame seating assembly comprises an upper transverse support member, a pair of seat tube mounts disposed thereon, seat member tubes, each being adapted for connection to a respective one of the seat tube mounts, and back-rest member tubes, each being adapted for connection to a respective one of the seat tube mounts.

21 Claims, 18 Drawing Sheets

Related U.S. Application Data

(60) Provisional application No. 63/378,530, filed on Oct. 6, 2022, provisional application No. 63/137,948, filed on Jan. 15, 2021.

(58) Field of Classification Search
CPC ..... A47C 7/441; A47C 7/444; A47C 7/443; A47C 7/4454; A47C 3/021; A47C 3/023
USPC ..... 297/32, 33
See application file for complete search history.

(56) References Cited

U.S. PATENT DOCUMENTS

| | | | | |
|---|---|---|---|---|
| 8,454,084 | B2 | 6/2013 | Lah | |
| 9,351,578 | B2 * | 5/2016 | Homans | A47C 4/02 |
| 10,653,244 | B2 * | 5/2020 | Yang | A47C 3/025 |
| 11,253,075 | B2 * | 2/2022 | Lah | A47C 4/42 |
| 11,969,102 | B2 * | 4/2024 | Sun | A47C 3/025 |
| 12,220,064 | B2 * | 2/2025 | He | A47C 4/44 |
| 2011/0148155 | A1 | 6/2011 | Chapman | |
| 2014/0217801 | A1 | 8/2014 | Homans et al. | |
| 2016/0113402 | A1 | 4/2016 | Lee | |
| 2018/0235367 | A1 * | 8/2018 | Ostwald | A47C 3/023 |
| 2019/0029430 | A1 * | 1/2019 | Yang | A47C 4/44 |
| 2020/0214450 | A1 * | 7/2020 | Garrison | A47C 7/624 |
| 2021/0112985 | A1 * | 4/2021 | Brensinger | A47C 1/0248 |
| 2023/0284778 | A1 * | 9/2023 | Yang | A47C 3/18 |
| 2023/0320487 | A1 * | 10/2023 | Jin | A47C 4/286 297/16.2 |
| 2023/0407670 | A1 * | 12/2023 | Graybill | E04H 15/44 |
| 2024/0108140 | A1 * | 4/2024 | He | A47C 4/02 |
| 2024/0215728 | A1 * | 7/2024 | Zhu | A47C 3/025 |
| 2025/0031853 | A1 * | 1/2025 | Zhang | A47C 4/30 |
| 2025/0134259 | A1 * | 5/2025 | Yang | A47C 4/44 |
| 2025/0151914 | A1 * | 5/2025 | Nuncio | A47C 1/14 |

FOREIGN PATENT DOCUMENTS

| | | | |
|---|---|---|---|
| CN | 211795405 | | 10/2020 |
| DE | 102020103226 | A1 | 8/2021 |
| EP | 2047769 | A1 | 4/2009 |
| EP | 2903479 | B1 | 12/2017 |

OTHER PUBLICATIONS

PCT Application No. PCT/US2022/012562, International Search Report and Written Opinion dated Apr. 20, 2022.

* cited by examiner

STOWAWAY COMPACT ROCKER

CROSS-REFERENCE TO RELATED APPLICATIONS

This application claims the benefit of U.S. Provisional Application Ser. No. 63/378,530, filed Oct. 6, 2022, which is incorporated herein by reference in its entirety. This application is also a continuation-in-part of U.S. patent application Ser. No. 17/648,088, filed Jan. 14, 2022, which claims the benefit of U.S. Provisional Application Ser. No. 63/137,948, filed Jan. 15, 2021, each of which is incorporated herein by reference in its entirety.

FIELD OF THE INVENTION

The present invention generally relates to collapsible furniture, and more particularly relates to improvements in rocking chairs or seats that can be readily set-up for use and collapsed for transportation and storage. Even more particularly, the present invention relates to a collapsible and portable stowaway compact rocker designed especially for use as a beach chair, lawn chair, and the like, where the rocker, in a set-up condition, can be rocked by a seated user, and where the rocker can be readily collapsed from the set-up condition to a collapsed condition for transportation and/or storage.

BACKGROUND OF THE INVENTION

Popularity of the minivan, the sport utility vehicle and the recreational vehicle has resulted in increased demand for improved collapsible furniture and particularly collapsible portable furniture of the outdoor type which may be readily stowed in a vehicle and conveniently manually transported to a picnic area or the site of a spectator event, such as, for example, an outdoor concert, a sporting event, a golf tournament, or an air show, where the general rule is to bring your own seating accommodations.

Considerable attention has been directed to the provision of improved lightweight, collapsible and portable furniture for the picnicker, camper, spectator, sportsman, hunter, fisherman, hiker, biker and the like. However, the resulting furniture designs and particularly designs for chairs and seats have usually incorporated some reduction in size, as compared to the full-sized article, with a corresponding reduction in the level of seating comfort, functionality and/or durability. The wooden beach chairs and lawn furniture of an earlier era have generally been replaced by light-weight tubular metal furniture of a more modern design. While newer lightweight designs have greatly improved transportability of such chairs, little has been done to optimize the collapsibility and portability of the full-sized article without compromising comfort and stability, which is a general goal of the present invention.

Beach and lawn chairs adapted to be folded for transportation and/or storage typically have a frame fabricated from elongated structural members, preferably metal. Such prior art chairs provide the convenience of easy fold-up and are lightweight so as to permit easy transportability. Common uses for such chairs are at the beach or at a picnic where easy set-up and break-down, as well as the ability to carry the chair along with other things is desirable. Due to the intricate interconnection of all the frame members, including for front-to-back, side-to-side and full X-Y quad chairs, such chairs often require all the legs to remain in contact with the ground to ensure safety and structural integrity of the chair during use. However, there is a desire for a rocking chair that is likewise foldable and portable, so that a user at a picnic or an outdoor event can relax in their chair and rock as desired.

Conventional beach and lawn chairs commonly have not been capable of rocking due to the design and construction of such chairs. For example, prior art pack chairs, which generally include chair frame members that can be attached to form a lightweight chair frame and detached to break down the chair and bundle the components for transportation and storage, have heretofore not had rocking capability. Adding components to help the user rock in such chairs while seated either has not been feasible due to the design of the chair frame and the means of connecting its component parts or has compromised the ability of the chair to be collapsed and/or bundled, as desired. Moreover, added components have compromised the size and weight of the chairs so that they no longer collapse to a small and lightweight bundle that is optimal for transportation and storage.

Additionally, existing foldable rocking chair designs are commonly not suitable for most outdoor uses, especially on soft ground, dirt or sand. The limitations of such prior art chairs are mostly due to the use of rocking components, such as arched rails/runners or compression springs that both provide rocking motion but also support the chair frame when set-up. With such designs, the chair generally does not maintain full contact by all legs with the ground or support surface. On soft ground or sand, this aspect increases the risk that one or both sides of the chair will sink into the ground, get bogged down, throw the chair frame off balance, overly torque or stress individual legs or frame component, be uncomfortable or unsafe during use, and ultimately affect the set-up condition of the chair, the rocking motion of the chair and, more significantly, the integrity and safety of the chair to support a seated user. Similarly, such portable rocking chairs may be used on uneven surfaces, and designs with rigid rails or runners may not be able to sit level on such surfaces, which in turn affects the ability to safely rock the chair.

In view of the foregoing, there is a need for a chair that can be rocked by a seated user when in a set-up condition that can also be collapsed in order to reduce the space occupied by the chair in a collapsed condition. Further, there is a need for such a chair that utilizes a common pack seat design that can act as a collapsible and portable stowaway rocker chair that is easy to set-up and break down. Further, there is a need for such a chair that can be collapsed with minimal effort, without limiting or compromising the structural features permitting set-up and rocking of the chair. Further, there is a need for a chair that can be rocked by a seated user, as desired, without compromising the collapsing and transport of the chair, and without affecting the safety and structural integrity of the chair, especially on all types of surfaces, including soft ground, sand and uneven surfaces. In this regard, there is a further need for a collapsible and portable stowaway rocker chair with an adjustable rocker mechanism, whereby a user can adjust the rocking capability of the chair to accommodate the user's specific desires and requirements for safe and comfortable use.

Accordingly, it is a general object of the present invention to provide a collapsible and portable rocking chair design of a compact stowaway chair, or pack seat, design that overcomes the problems and drawbacks associated with folding chairs and rocking chairs, and therefore significantly improves the utility of such a rocking chair in the set-up condition while permitting easy transportation and/or storage in a collapsed condition.

The present invention addresses these issues and provides means to circumvent the associated drawbacks of such prior art collapsible and portable rocking chair designs.

SUMMARY OF THE INVENTION

The present invention is directed to a stowaway compact rocking chair design that is collapsible and portable, and especially suitable for use as a beach chair, a lawn chair, and the like, where the chair, in a set-up condition, can be rocked by a seated user, and where the chair can be folded from the set-up condition to a collapsed condition for transportation and/or storage.

In accordance with a first embodiment of the present invention, a stowaway compact rocker having a set-up condition and a collapsed and bundled condition, and further having rocking capability when in the set-up condition comprises a stationary chair frame base and a movable chair frame seating assembly adapted for rocking movement relative to the stationary chair frame base. In embodiments, the stationary chair frame base comprises a lower transverse support member, a pair of leg mounts disposed at opposing longitudinal ends of the lower transverse support member, and a pair of front leg tubes and a pair of rear legs tubes, each of said front leg tubes and rear leg tubes being adapted for connection to one of the leg mounts. In embodiments, the movable chair frame seating assembly comprises an upper transverse support member, a pair of seat tube mounts disposed at opposing longitudinal ends of the upper transverse support member, a pair of seat member tubes, each of said seat member tubes being adapted for connection to a respective one of the seat tube mounts, and a pair of back-rest member tubes, each of said back-rest member tubes being adapted for connection to a respective one of the seat tube mounts. The rocker also includes a compliant member or assembly, such as a spring plate, connected between the lower transverse support member and the upper transverse support member.

The rocker further includes a seating fabric removably mounted to the seat member tubes and the back-rest member tubes of the chair frame in the set-up condition of the rocker. The seating fabric defines a chair seat and a chair back-rest adapted to receive a seated user in the set-up rocker. In the set-up condition of the rocker, the movable chair frame seating assembly is adapted for movement relative to the stationary chair frame base when a pressure is applied to at least one of the chair seat and the chair back-rest by a seated user. The seating fabric may be removed from the chair frame during collapsing of the chair frame to its collapsed and bundled condition.

In accordance with the present invention, rocking capability is supplied by a rocking mechanism incorporated into the chair frame design. In embodiments of the present invention, the rocker mechanism comprises compliant members engaged between movable components (e.g., the movable chair frame seating assembly) and stationary components (e.g., the stationary chair frame base), such as plate springs, cantilevered springs, leaf springs, transversely extending spring rods, torsion springs, and the like.

In preferred embodiments of the present invention, a plate spring is connected between the movable components (e.g., the movable chair frame seating assembly; the upper transverse support member) and stationary components (e.g., the stationary chair frame base; the lower transverse support member). In embodiments, the plate spring is horizontally disposed. In other embodiments, the plate spring is vertically disposed. In still other embodiments, the plate spring can be angularly disposed to maximize the rocking motion. Additionally, in embodiments of the present invention, a single plate spring may be used, or multiple plates springs, spread along the transverse direction of the chair frame, may be used. Still further, the plate spring(s) can be reinforced to accommodate users of heavier weights. Still further, the plate spring(s) can be adjustable to increase or decrease rigidity and flexibility to correspond to the weight of the user and/or a desired rocking motion.

In an aspect of the present invention, the front leg tubes and the rear leg tubes are adapted to be disengaged from the leg plates for collapsing the rocker to its collapsed and bundled condition. Likewise, the seat member tubes and the back-rest member tubes are adapted to be disengaged from the seat tube plates for collapsing the rocker to its collapsed and bundled condition. In preferred embodiments of the present invention, the front leg tubes, rear leg tubes, seat member tubes and back-rest member tubes are shock-corded to remain connected to the rocker even when in the collapsed and bundled condition of the rocker. Further, each removable frame member tube may include means for connecting the member tube to the central hub of the collapsed rocker to maintain the collapsed and bundled condition during storage and/or transportation.

These and other features of the present invention are described with reference to the drawings of preferred embodiments of a collapsible and portable rocking chair. The illustrated embodiments of features of the present invention are intended to illustrate, but not limit the invention.

DETAILED DESCRIPTION OF EMBODIMENTS OF THE INVENTION

The present invention is generally directed to collapsible and portable rocking chairs, and more particularly, a stowaway compact rocker especially suitable for outdoor use as a beach chair, lawn chair, and the like, where the rocker, in a set-up condition, can be rocked by a seated user, and where the rocker can be readily collapsed from the set-up condition to a compact collapsed condition for transportation and/or storage.

Figure 11:
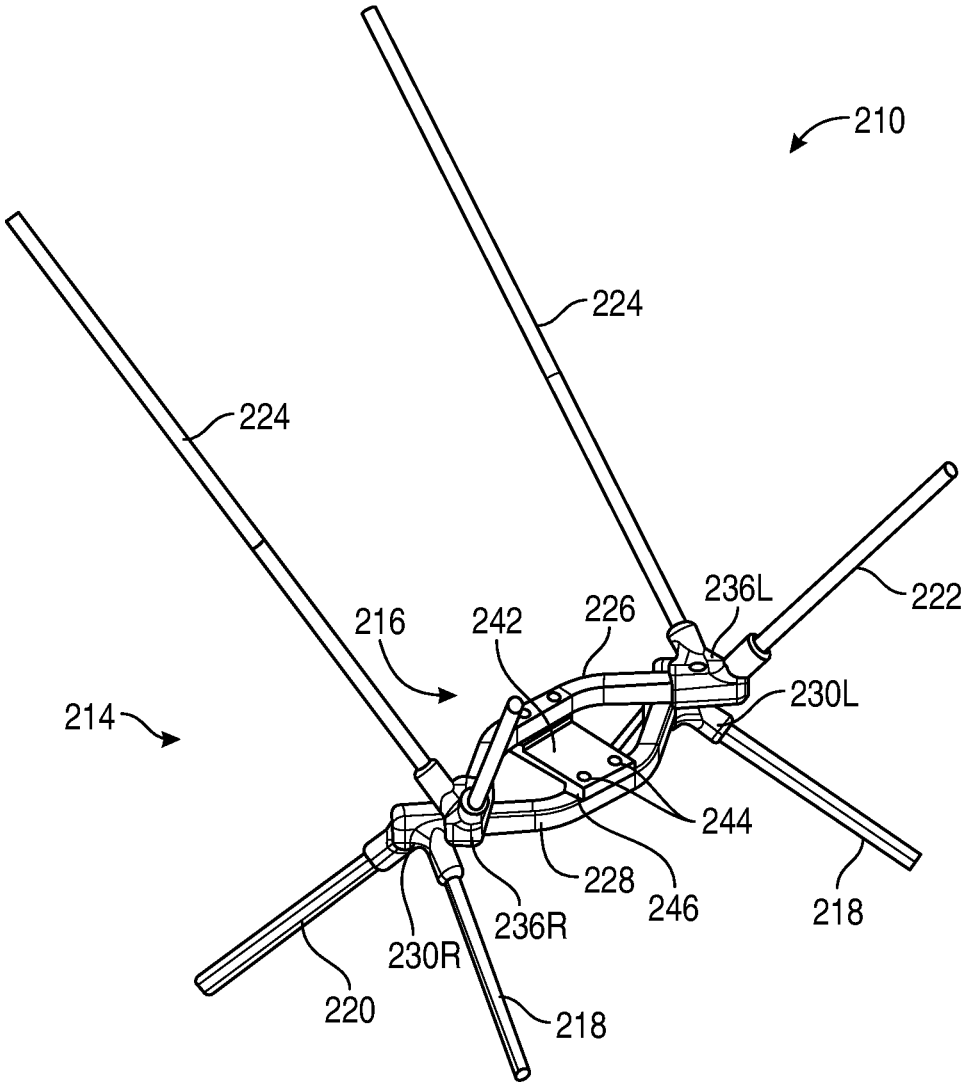
FIG. 11 illustrates a perspective view of a third embodiment of a chair frame for a stowaway compact rocker in accordance with the present invention.
Figure 12:
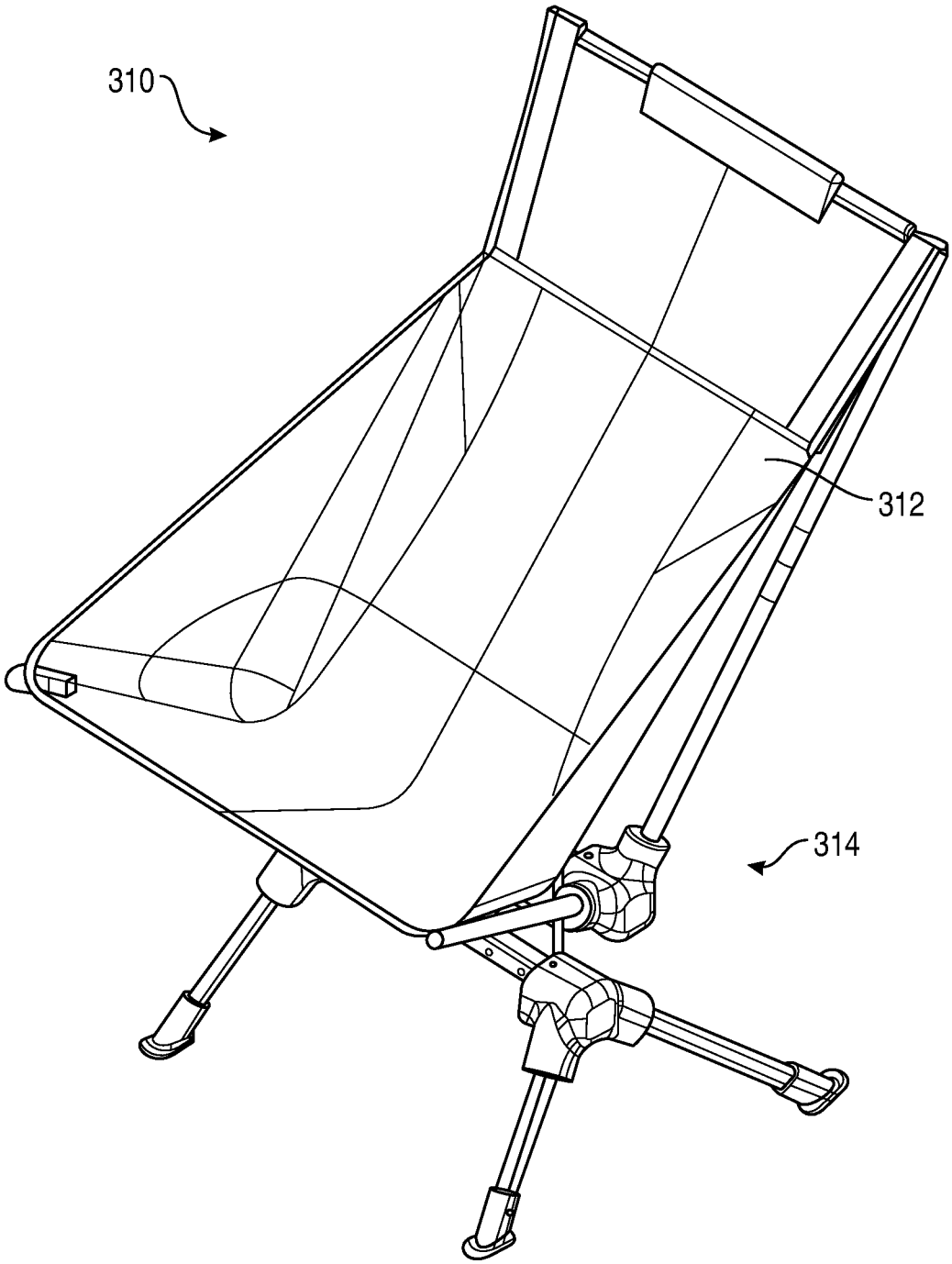
FIG. 12 illustrates a perspective view of a fourth embodiment of a stowaway compact rocker in accordance with the present invention.
Figure 13:
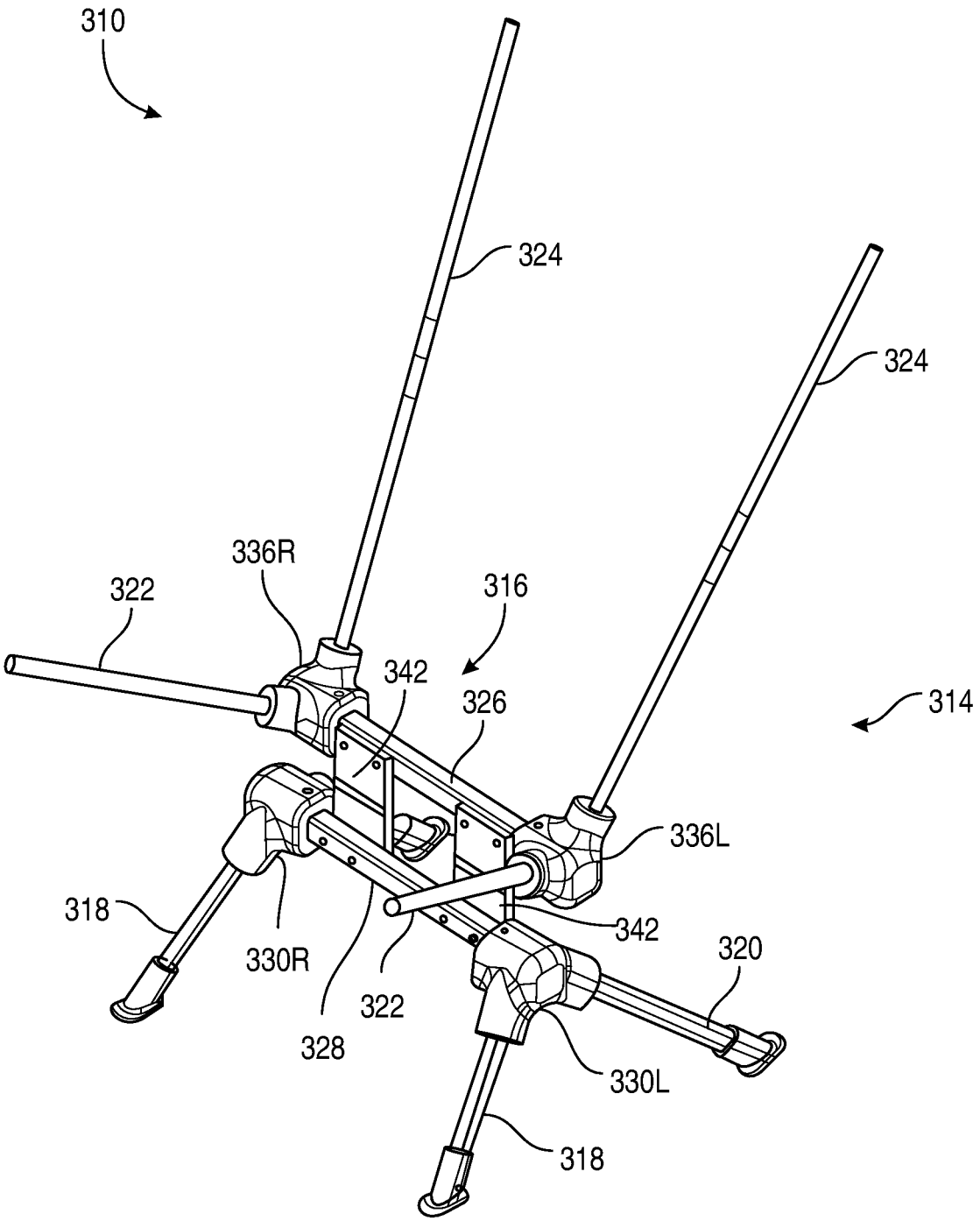
FIG. 13 illustrates a perspective view of a chair frame for the stowaway compact rocker of FIG. 12 in a set-up condition.

In the drawings and the description that follows, the present invention is illustrated and described with reference to stowaway compact rocker designs embodying the present invention. A first embodiment of such a rocker, generally designated as reference numeral 10, is illustrated in FIGS. 1-6. A second embodiment of a stowaway rocker in accordance with the present invention, generally designated as reference numeral 110, is illustrated in FIGS. 7-10. A third embodiment of a stowaway rocker in accordance with the present invention, generally designated as reference numeral 210, is illustrated in FIG. 11. A fourth embodiment of a stowaway rocker in accordance with the present invention, generally designated as reference numeral 310, is illustrated in FIGS. 12-17. A fifth embodiment of a stowaway rocker in accordance with the present invention, also generally designated as reference numeral 310, is illustrated in FIG. 18.

Figure 1:
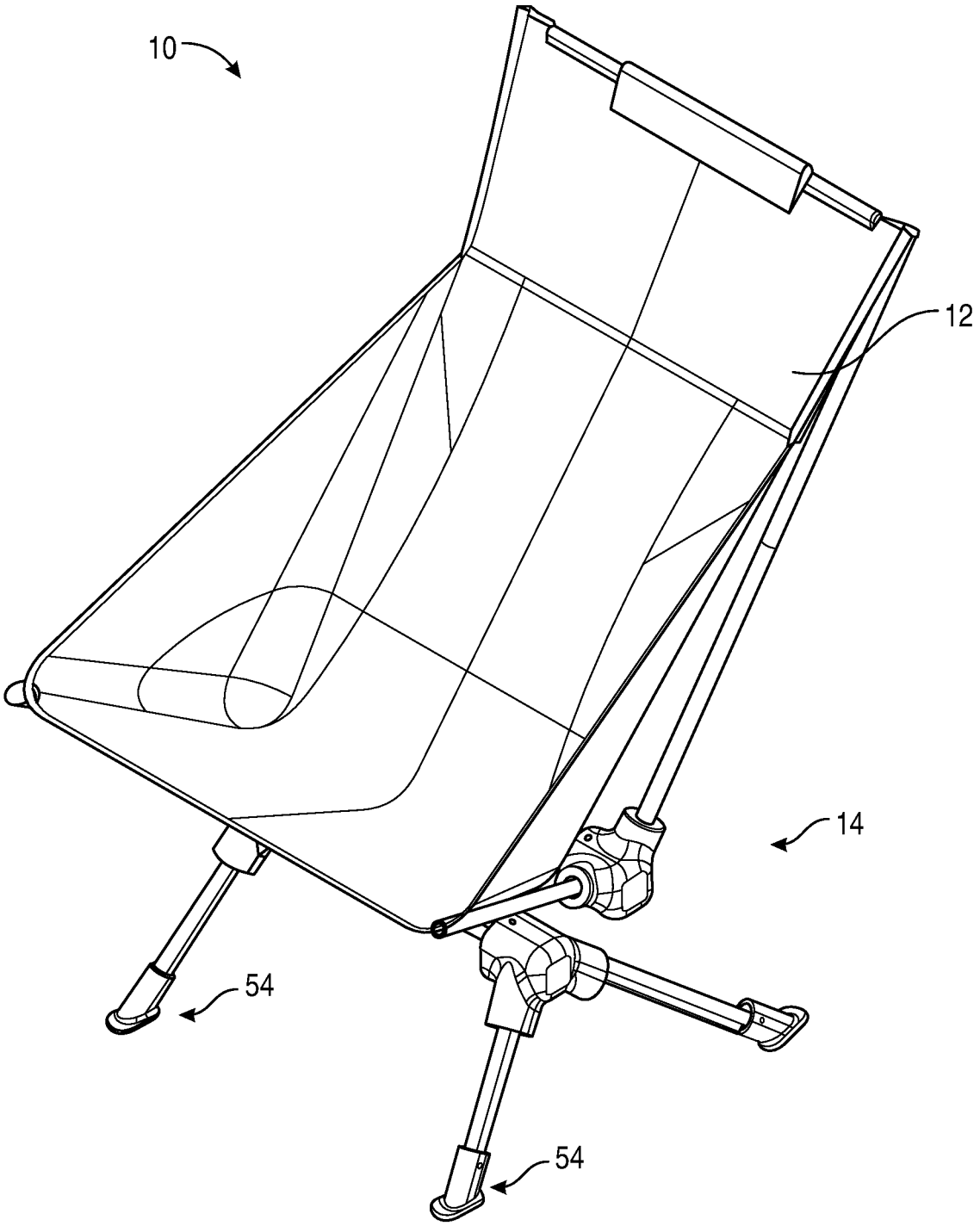
FIG. 1 illustrates a perspective view of a first embodiment of a stowaway compact rocker in accordance with the present invention.
Figure 2:
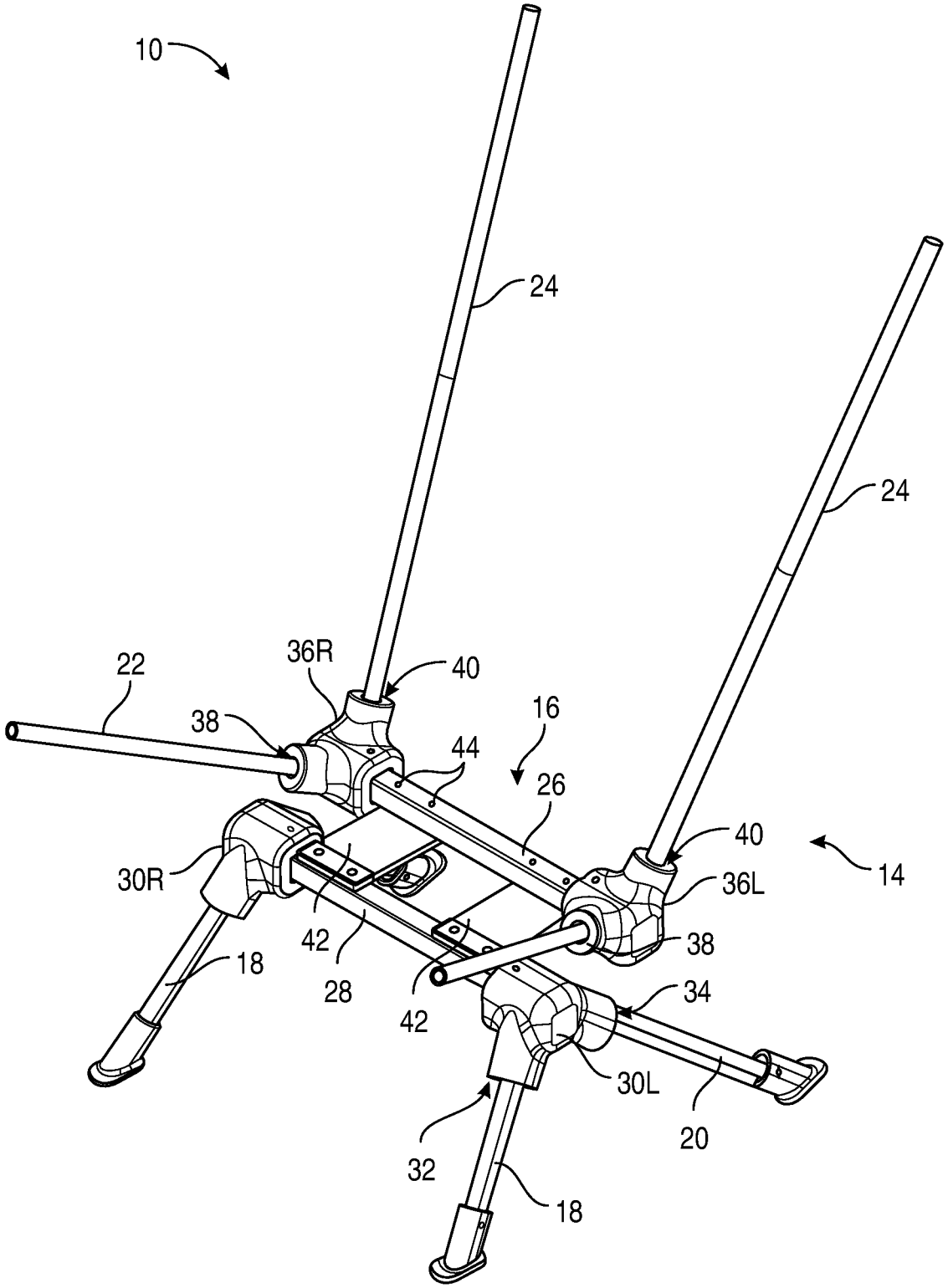
FIG. 2 illustrates a perspective view of a chair frame for the stowaway compact rocker of FIG. 1 in a set-up condition.
Figure 6:
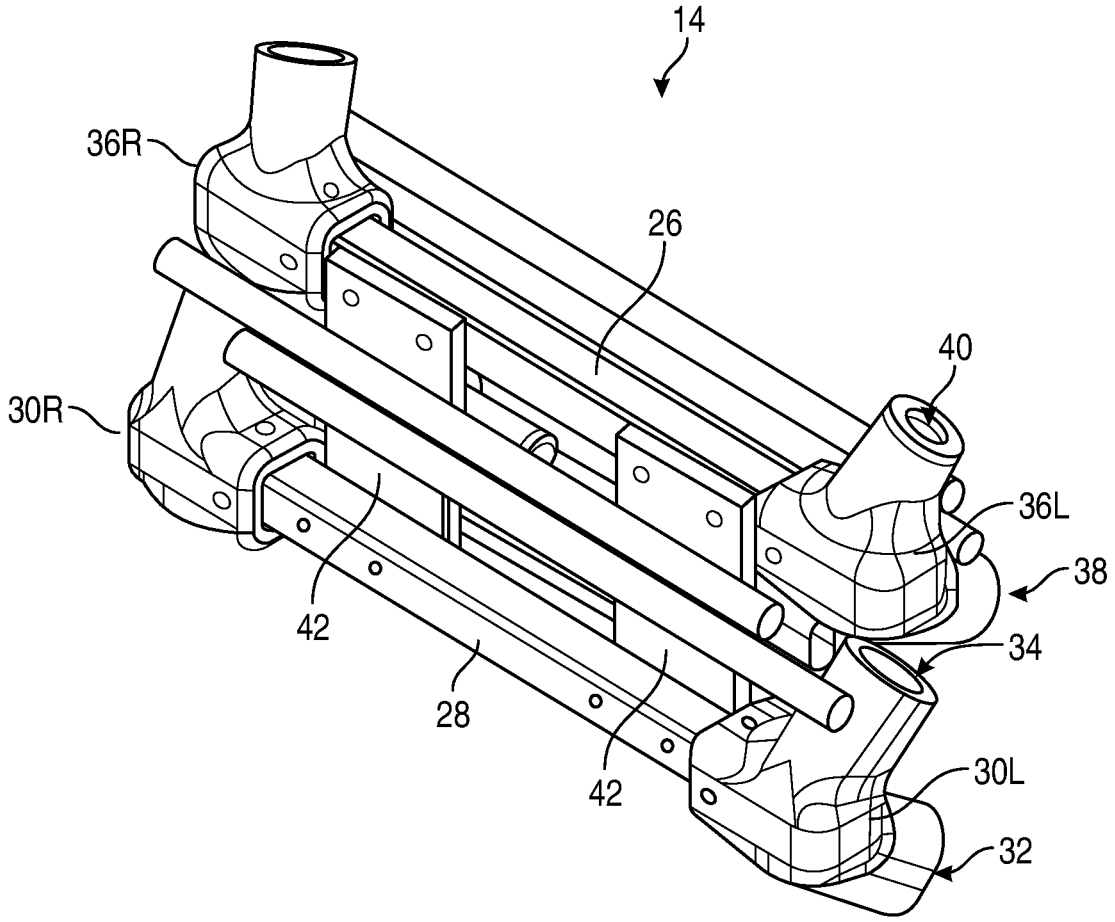
FIG. 6 illustrates a perspective view of the chair frame of FIG. 1 in a collapsed condition.
Figure 7:
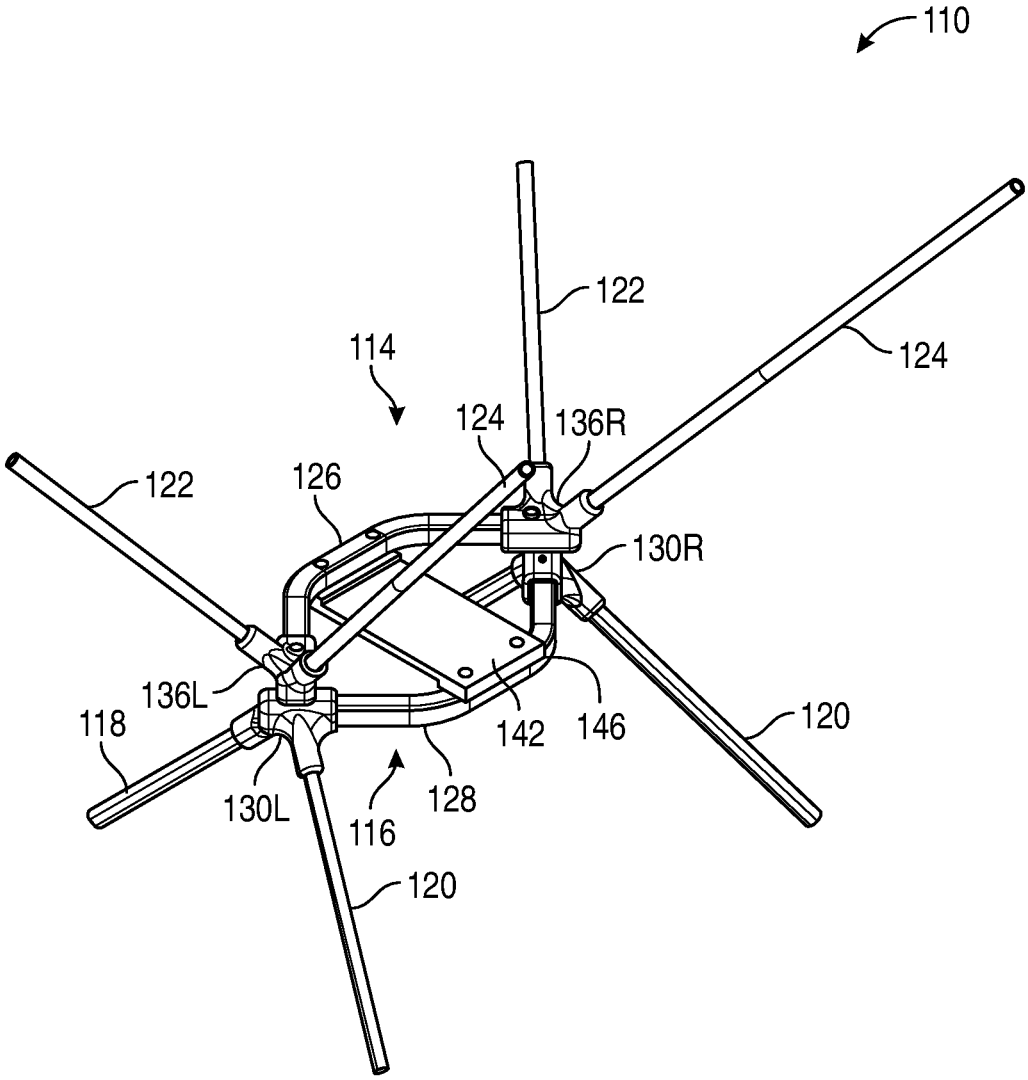
FIG. 7 illustrates a perspective view of a second embodiment of a chair frame for a stowaway compact rocker in accordance with the present invention.

Referring to FIGS. 1-2, a stowaway compact rocker 10 in accordance with the present invention is illustrated in a set-up condition for use. FIG. 1 illustrates the rocker 10 with a seating fabric 12 removably mounted on a chair frame 14 for use. FIG. 2 illustrates the chair frame 14 with the seating fabric 12 removed for illustration on key components of the chair frame 14. More particularly, a user can sit in the set-up rocker 10, and in accordance with the present invention, rock in the rocker 10 as desired. The stowaway compact rocker 10 can be easily set-up for use in a variety of environments, and especially for outdoor use at picnics, concerts, sporting events and the like. Likewise, the stowaway compact rocker 10 can be easily collapsed into a collapsed and bundled condition, such as illustrated in FIG. 6, for transport and/or storage when not in use. In FIG. 6, seating fabric 12 is removed to illustrate the collapsed and bundled relationship of the chair frame components in the collapsed and bundled condition of the chair 10 and chair frame 14.

Referring to FIG. 2, the stowaway compact rocker 10 comprises a chair frame 14. Many components of the chair frame 14 are consistent with conventional pack seat designs. Notably, the chair frame 14 comprises a pair of front leg tubes 18 projecting forward and angled downward from a central hub 16, a pair of rear leg tubes 20 projecting rearward and angled downward from the central hub 16, a pair of seat tubes 22 projecting forward and angled upward from the central hub 16, and a pair of back-rest tubes 24 projecting rearward and angled upward from the central hub 16. Each of the front leg tubes 18, rear leg tubes 20, seat tubes 22 and back-rest tubes 24 is removably connected to the central hub 16, and when so attached, as illustrated in FIG. 2, define the chair frame 14 and support a seating fabric 12 to receive a seated user. In the alternative, these frame members could remain connected to the central hub 16 and be movable between set-up and collapsed conditions, for example via pivotal, sliding, telescoping and flexing connection, and combinations thereof.

The seating fabric 12, as mounted on the chair frame 14, is illustrated in FIG. 1, and is preferably provided in one piece. When the rocker 10 is not needed, the rocker 10 can be collapsed into a collapsed condition, as illustrated in FIG. 6, by first removing the seating fabric 12, and then disengaging the tube members 18, 20, 22 and 24 from the central hub 16, much in the manner illustrated in FIG. 5. The removed members can be bundled with the central hub portion for easy transportation and/or storage of the collapsed rocker 10. Indeed, a bundled chair frame 14, as shown in FIG. 6, can be wrapped in the seating fabric 12, and then further stored in a storage/carrying bag (not shown). In alternate embodiments, the seating fabric 12 can be designed to act as a storage and carrying bag for the collapsed and bundled chair frame 14.

In preferred embodiments, the tube members 18, 20, 22 and 24 are internally shock-corded to facilitate ready and quick assembly and disassembly and allow for compact storage when the rocker 10 is not in use without risk of losing parts. This design also facilitates keeping the chair components together in a bundled condition when the rocker 10 is collapsed, as shown in FIG. 6.

Figure 5:
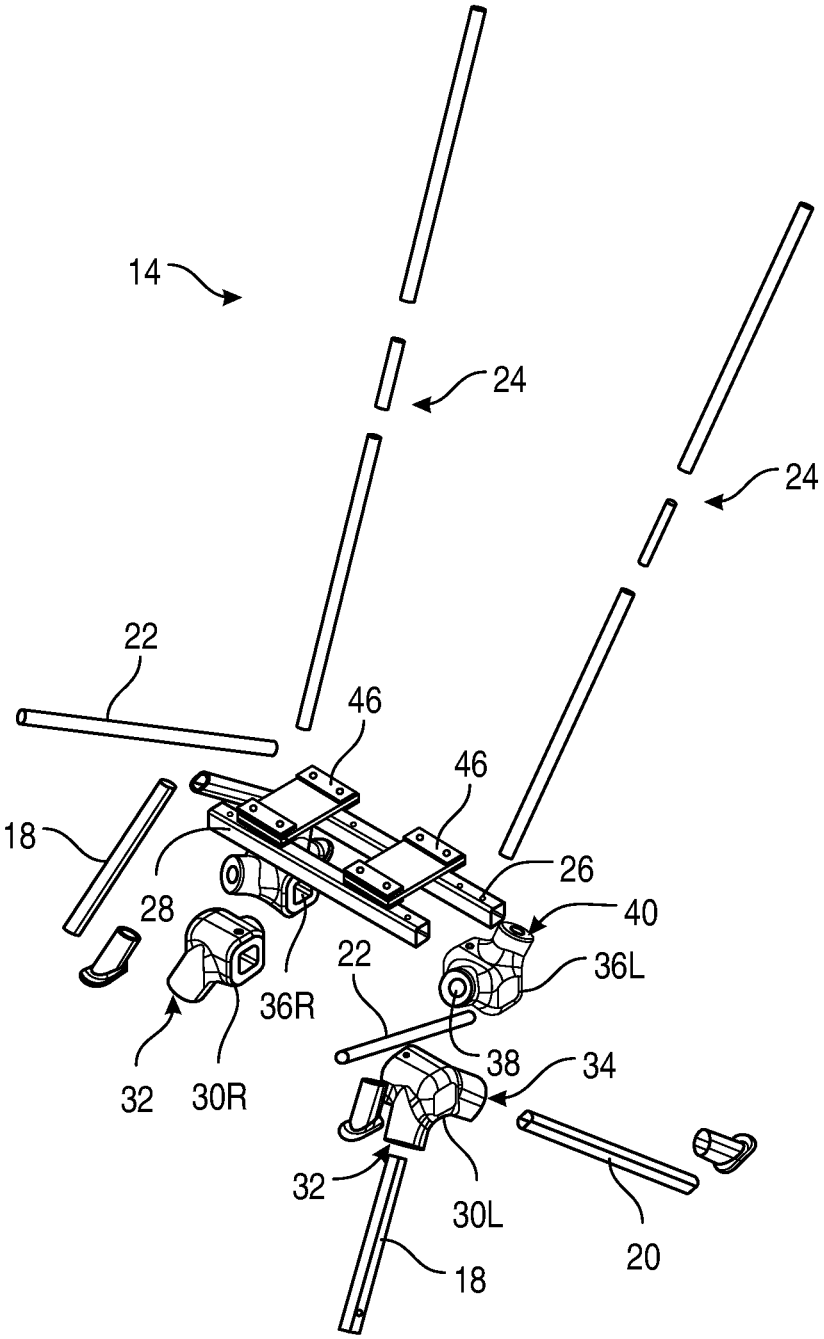
FIG. 5 illustrates an exploded perspective view of the chair frame of FIG. 2.

Referring to FIGS. 2-5, the front leg tubes 18, rear leg tubes 20 and seat tubes 22 are preferably made of single-piece construction of lightweight but rigid metal, for example, aluminum, but may also be fabricated from high-strength plastic. While the back-rest tubes 24 may also be made of single piece construction, they are preferably designed to be sectionalized, telescopically or otherwise, as illustrated in FIG. 5 (exploded view), to reduce the footprint of the collapsed bundle while providing a high back-rest in the set-up condition of the pack seat rocker 10. Though not illustrated, a removable headrest brace may be provided at the top of the back-rest tubes 24 to define and strengthen the head rest portion of the back-rest. The back-rest tubes 24 are likewise made of lightweight but rigid construction, for example, metal (such as aluminum) or high-strength plastic, and may be shock-corded together to facilitate ready assembly and disassembly of the pack seat rocker 10.

Various elongated structural parts or members comprising the chair frame 14 are preferably constructed from tubular material of circular cross-section, or in the alternative, or non-circular cross-section, such as, for example, extruded aluminum tubing having oval, elliptical, or square cross-section. Additionally, elongated structural parts and members illustrated and described herein, though illustrated as single piece in accordance with preferred embodiments of the present invention, may be constructed from multiple pieces collectively functioning in an equivalent manner to a single-piece construction without departing from the spirit and principles of the present invention. Accordingly, use of the terms "tube", "member" or "tube member" herein are intended to cover single-piece and multi-piece constructions, unless otherwise specified herein.

Referring to FIGS. 2-5, the unique core or central hub 16 in accordance with the present invention is illustrated. Notably, each of the embodiments of the stowaway compact rocker of the present invention, unlike conventional pack seats available on the market, can be rocked by a seated user.

Conventional pack seats merely provide a stationary seat when set-up. In the present invention, the rocking action is supplied by a rocking mechanism for effectuating a rocking motion between movable and stationary components of the chair frame. In the illustrated embodiment, the rocking mechanism comprises compliant linear-flex or cantilevered members or spring plates disposed within the central hub 16. More particularly, a spring force is provided by flexing the compliant members, such as by bending or flexing linear-flex, plate or cantilever springs. Moreover, the present invention may permit adjustment of the tension, rigidity and flexibility of the linear-flex, plate, or cantilever springs to increase or reduce the rocking action of the stowaway compact rocker.

Though multiple plate springs are illustrated in the embodiment of FIGS. 2-5, the compliant member may comprise a single plate spring, such as illustrated in the embodiments of FIGS. 7-11, without departing from the principles and spirit of the present invention.

Referring back to FIGS. 2-5, the central hub 16 comprises a stationary portion and a movable portion. The stationary portion comprises a transversely-extending lower support member 28 mounted between left and right leg mounts 30L and 30R, each having mirrored construction to one another. A respective front leg tube 18 and rear leg tube 20 is connected to each of the leg mounts 30L, 30R for set-up of the rocker 10. For example, each leg mount 30L, 30R includes front and rear cavities 32 and 34 adapted to snugly and securely receive the front and rear leg tubes 18 and 20, respectively. The leg tubes 18 and 20 can be removably snap fit into the cavities 32 and 34 to ensure a solid connection so that the set-up rocker 10 remains stable and sturdy when a user is seated, and especially when a user is rocking in the rocker 10. As noted, each of these components—the lower support member 28, the left and right leg mounts 30L, 30R, and the front and rear leg tubes 18 and 20, generally remain stationary when the rocker 10 is in its set-up condition, regardless of whether the user is rocking the seat or sitting stationary. In operation, especially with seated users of greater weight, the lower support member 28 may have some slight flexing movement during rocking of the chair 10, or the legs 18, 20 might slide or shift slightly; however, for all intents and purposes, the lower support member 28 and the front and rear leg tubes 18 and 20 are "stationary" relative to the moving components of the chair 10 (described in more detail below) as any such flexing or shifting movement is nominal compared to the extent of movement of the actually "moving" components.

Figure 3:
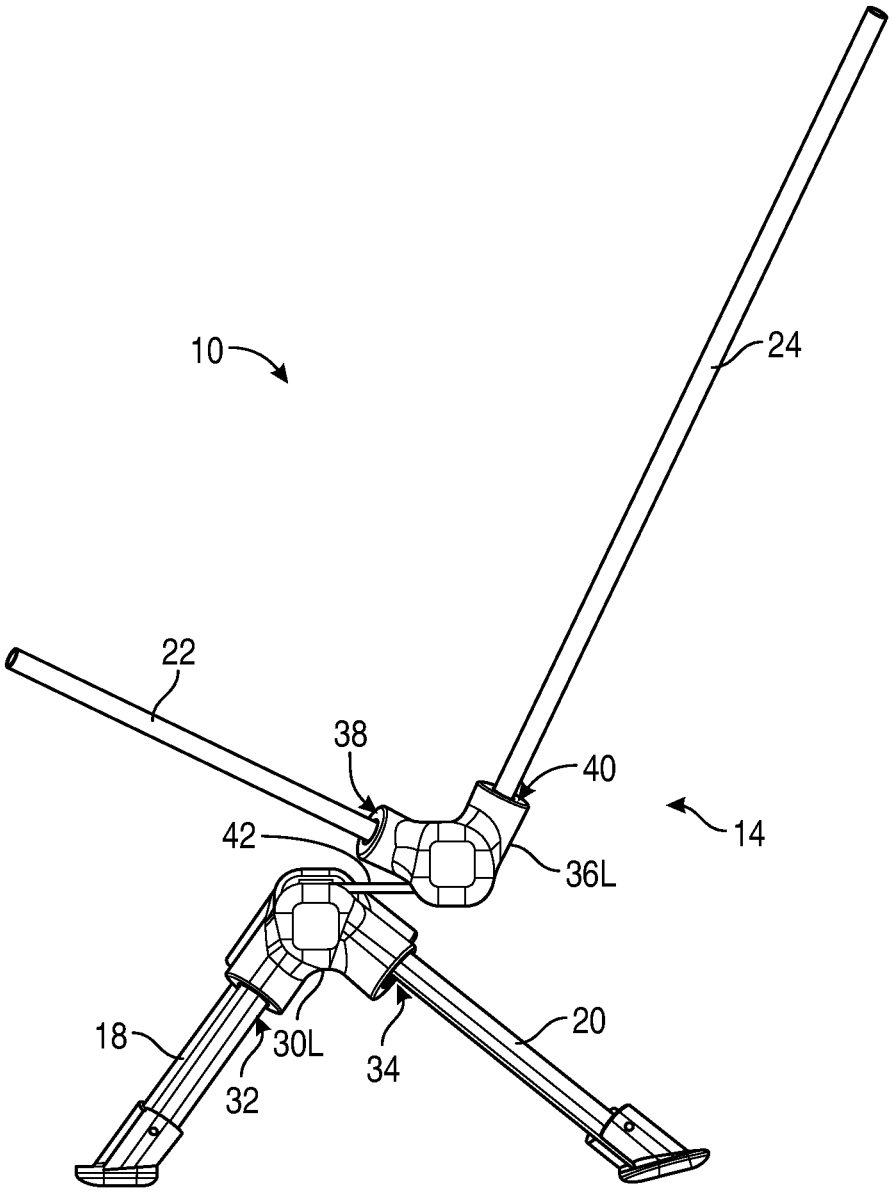
FIG. 3 illustrates a planar side view of the chair frame of FIG. 2.
Figure 4:
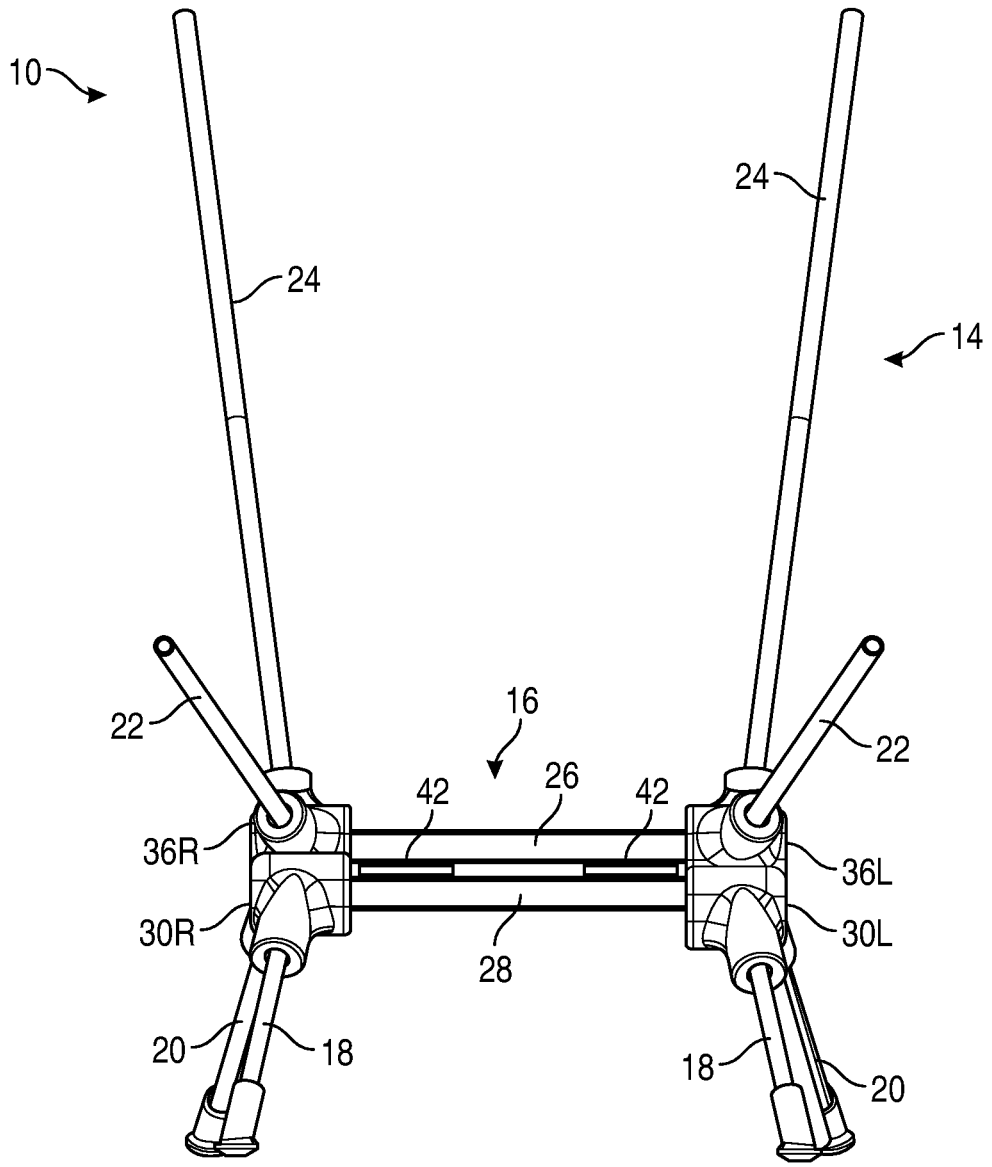
FIG. 4 illustrates a planar front view of the chair frame of FIG. 2.
Figure 8:
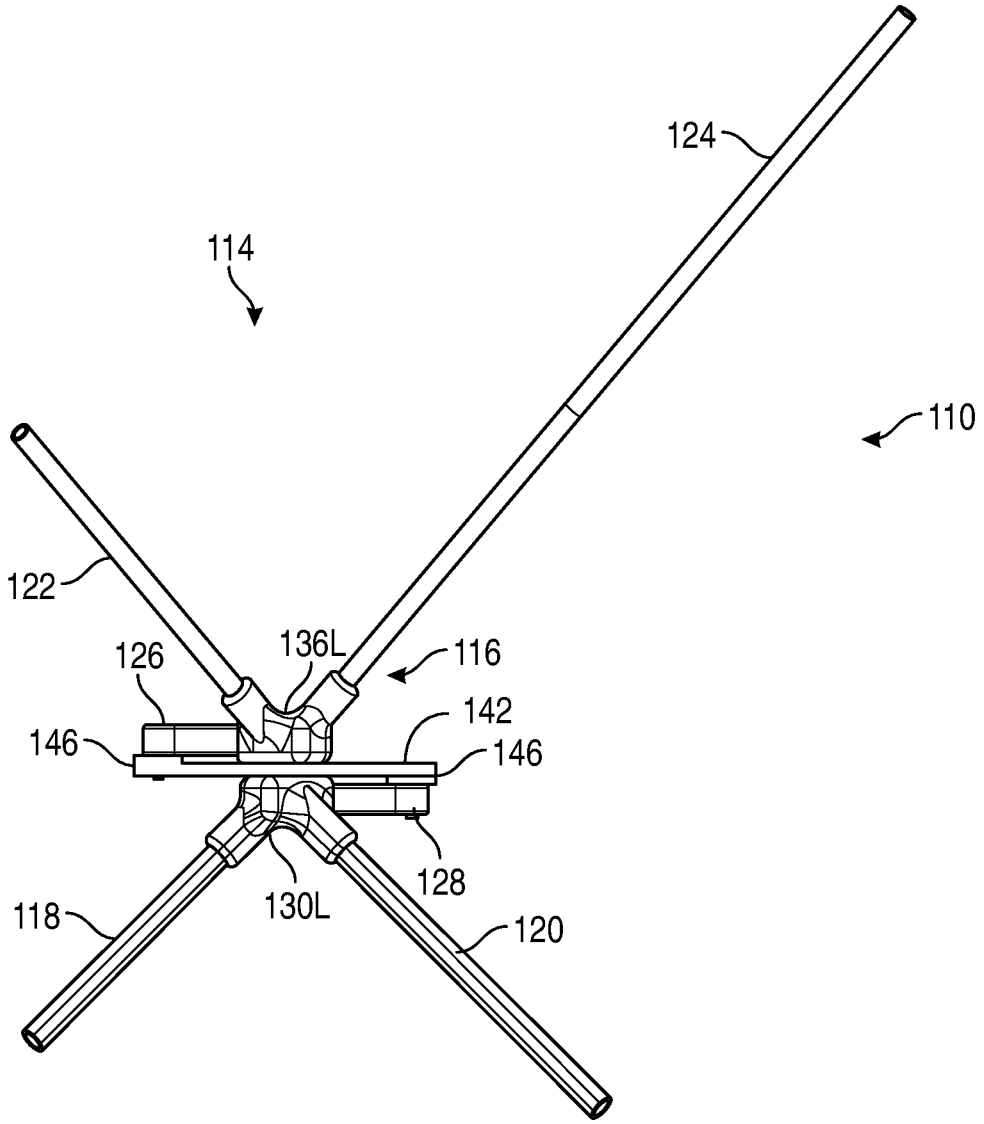
FIG. 8 illustrates a planar side view of the chair frame of FIG. 7.
Figure 9:
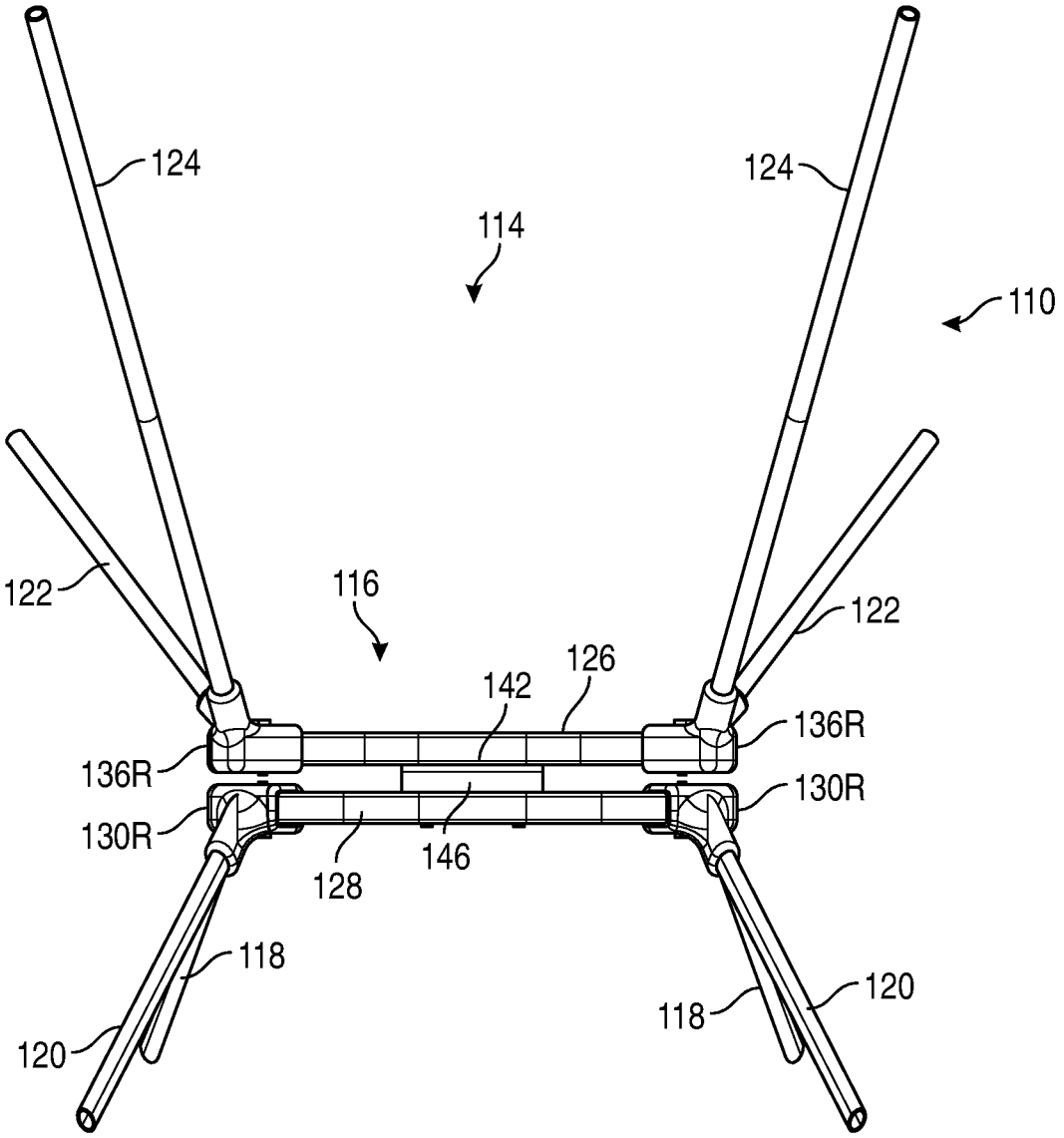
FIG. 9 illustrates a planar front view of the chair frame of FIG. 7.
Figure 10:
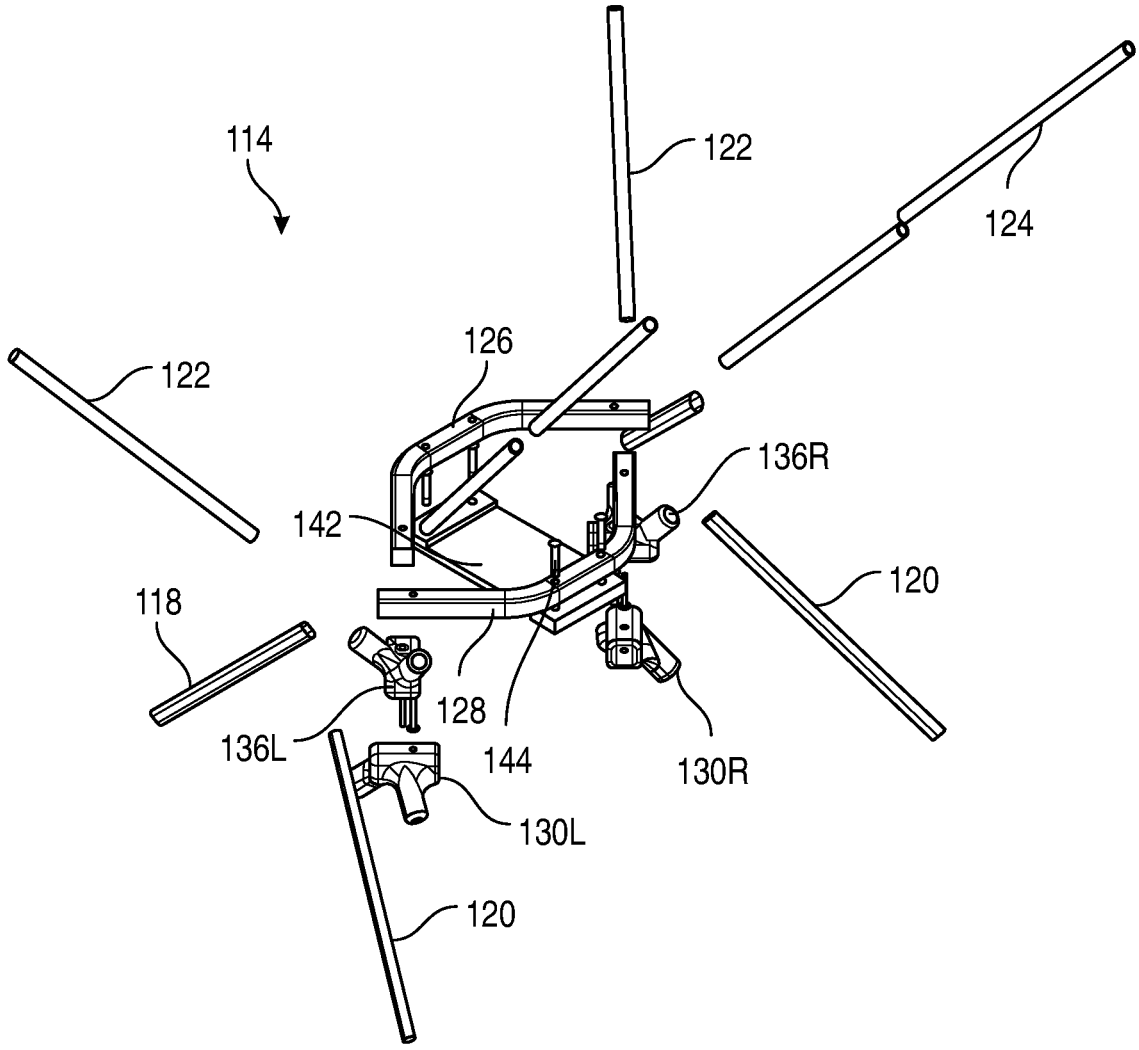
FIG. 10 illustrates an exploded perspective view of the chair frame of FIG. 7.

The movable portion of the central hub 16 comprises a transversely-extending upper support member 26, and left and right seat tube mounts 36L and 36R, each having mirrored construction to one another, that are mounted for movement with the upper support member 26. The seat tube mounts 36L, 36R are preferably positioned adjacent to, but offset from, respective leg mounts 30L, 30R, as illustrated in FIG. 3. In alternate embodiments, the seat tube mounts 36L, 36R may be positioned adjacent to and transversely in line with respective leg mounts 30L, 30R, as illustrated in FIG. 8. During rocking use of the stowaway compact rocker 10, the seat tubes 22 and the back-rest tubes 24 will move with the pivoting motion of the seat tube mounts 36L, 36R and the upper support member 26 relative to the lower support member 28. Each seat tube mount 36L, 36R includes cavities 38 and 40 for respectively receiving a seat tube 22 and a back-rest tube 24. The cavities 38, 40 are adapted to snugly and securely receive the seat and back-rest tubes 22 and 24. The seat tubes 22 and the back-rest tubes 24 can be removably snap fit into respective cavities 38 and 40 to ensure a solid connection so that the set-up rocker 10 remains stable and sturdy when a user is seated, and especially when the user is rocking.

As noted, in preferred embodiments, the central hub 16 further includes a rocking mechanism comprising compliant linear-flex or cantilevered plate members, hereinafter referred to as "spring plates" disposed within the central hub 16. As shown in the embodiment of FIG. 2, longitudinally-extending (i.e., front-back) spring plates 42 are mounted between respective central portions of the lower transverse support member 28 and the upper transverse support member 26. More particularly, a spring force is provided by flexing the compliant member, such as by bending or flexing the spring plates 42, which act as a linear-flex spring or cantilever spring when under a sufficient flexing force, such as the rocking movement initiated by a seated user.

In preferred embodiments, the spring plates 42 are transversely spread out between the left and right sides of the chair frame 14. Alternatively, the springs plates 42 can be more centrally located, or even replaced by a single spring plate, such as illustrated in FIGS. 7-11, without departing from the principles and spirit of the present invention. Similarly, though the upper and lower transverse support members 26 and 28 are illustrated as straight members, one or both can have an arced design, allowing for a greater length of the spring plate(s) to increase the amount of rocking motion permitted by the chair frame 14. In the case where both upper and lower transverse support members 26 and 28 have an arced design, it is preferable that the designs have mirrored constructions.

The spring plates 42 are secured at each end to the upper and lower transverse support members 26 and 28, preferably by bolts or pins 44. As noted, the spring plates 42 can comprise multiple distinct plates, positioned tightly together in the transverse center of the chair frame 14 or spread out along the transverse extent of the central hub 16. In the alternative, a single centrally-positioned spring plate 42 may be used without departing from the principles and spirit of the present invention. Additionally, though the upper and lower transverse support members 26 and 28 are illustrated as single-piece members, the transverse support members 26 and 28 can be constructed from multiple pieces designed to collectively bridge and connect the left and right side of the chair frame 14 to respectively define the stationary portion and movable portion of the chair frame 14 and also support the respective ends of the spring plate(s) 42.

Referring to FIGS. 2-3, the spring plates 42 are generally disposed in a horizontal plane when in a state of rest—i.e., when the user is not rocking in the chair 10. As so disposed, the spring plates 42 and the upper and lower transverse support members 26 and 28 work to suspend the movable portion of the chair frame 14 above and relative to the stationary portion of the chair frame 14. As illustrated in FIG. 3, the movable portion of the chair frame 14 is slightly offset from the stationary portion of the chair frame 14. In this regard, the seat tube mounts 36L, 36R are positioned adjacent to, but offset from, respective leg mounts 30L, 30R. This allows for a more compact design of the chair frame 14, allowing for desired rocking capability without compromising the desired size and footprint for the chair frame 14 either in its set-up or collapsed conditions. However, alternate designs can position the movable portion above the stationary portion, which will allow for a different range of motion. For example, as illustrated in FIG. 8, the seat tube mounts 36L, 36R may be horizontally aligned with respective leg mounts 30L, 30R.

Moreover, a gap is provided between sets of seat tube mounts 36L, 36R and leg mounts 30L, 30R. This gap allows for pivoting motion of the moveable portion of the chair frame 14 relative to the stationary portion without the portions contacting and interfering with the rocking movement of the chair 10. Additionally, when a user is seated in the chair 10, and especially when said user has greater weight, the movable portion of the chair frame 14 may sag more closely to the stationary portion. The predefined gap permits a certain amount of sagging without inhibiting intended operation of the rocker 10. The gap is further defined by the shape of the spring plates 42—as illustrated in FIG. 3, the spring plates 42 include spacers 46 on each end at the point of connection with the upper and lower transverse support members 26 and 28. Additional stoppers, such as wedge-shaped placeholder blocks, can be provided on the chair frame 14 to limit forward and/or rearward travel during rocking.

The afore-mentioned "horizontal" plane for the spring plates 42 in their state of rest is defined in relation to the ground surface on which the chair 10 is set-up. Notably, if the chair 10 is set-up on a slight incline or decline, then the "horizontal" plane will not be a true horizontal plane, but rather generally parallel to a virtual plane defined by the support surface (i.e., ground). In further reality, the spring plates 42 can have some nominal deviation from the true horizontal plane (or the plane parallel to the virtual plane of support surface) in accordance with the principles and spirit of the present invention. Indeed, as illustrated in the embodiments of FIGS. 12-18, the spring plates 42 do not need to be horizontal, and can be vertically disposed, as illustrated there, or otherwise angularly disposed, without departing from the principles and spirit of the present invention. In this regard, "generally horizontal plane" is used to distinguish from a spring plate disposed vertically or at a clear angle in the set-up condition of the chair 10.

In use of the set-up stowaway compact rocker 10 for rocking motion, when the seated user leans back on the back-rest or forward on the seat, the movable portion of the central hub 16 will pivot or rotate backwards and forward relative to the stationary portion of the central hub 16. Thus, the upper support member 26 and the seat tube mounts 36L and 36R attached thereto will rotate about a central transverse axis relative to the stationary portion of the chair frame 14—namely, the lower support member 28, the leg tube mounts 30L, 30R and the front and rear legs 18 and 20. The rocking force applied by the seated user generates a spring force in the spring plates 42. In use, the front and rear legs 18 and 20 remain stationary, as the set-up chair 10 is intended to be positioned on a ground surface. The stationary front and rear legs 18 and 20 stabilize the lower support member 28 through the leg tube mounts 30L, 30R. Thus, the movable portion of the chair frame 14—namely, the upper support member 26, the seat tube mounts 36L, 36R, and the seat tubes 22 and back-rest tubes 24, will be permitted to pivot with flexing of the spring plate 42. As a result, the seat and back-rest portions of the rocker 10 will also move in backwards and forwards directions. The rocking motion of the movable portion of the central hub 16 will cause the spring plates 42 to bend and flex with motion of the movable portion of the rocker 10. The flexing of the spring plates 42 essentially creates a spring or compliant member supplying the rocking action of the rocker seat, flexing in one direction and then the other in connection with back-and-forth rocking motion of the rocker 10.

To collapse the stowaway compact rocker 10, the seating fabric 12 is removed from the chair frame 14. Then, the frame tube members 18, 20, 22 and 24 described herein are disengaged from the central hub 16 to create a seat bundle (FIG. 6) for easy transport or storage of the rocker 10. As noted, each of the frame tube members 18, 20, 22 and 24 is preferably internally shock-corded so that all the frame members stay connected, cannot be lost, and can be easily reconnected to set-up the rocker 10 in an efficient and quick fashion. For example, as illustrated in FIGS. 5-6, the front and rear leg tubes 18 and 20 are removed from their cavities 32 and 34 in the leg plates 30L and 30R and preferably repositioned in generally parallel relationship to the central axle tube 28. Likewise, the seat tubes 22 are removed from their cavities 38 in the seat tube plates 36L and 36R and similarly positioned generally parallel to the central axle tube 28. The back-rest tubes 24 are also removed from their cavities 40 in the seat tube plates 36L and 36R, and the sectioned portions of said back-rest tubes 24 are disengaged, and all components bundled and repositioned generally parallel to the upper and lower transverse support members 26 and 28. Once all the frame members have been removed and bundled, the entire bundle can be wrapped with the seating fabric 12 and placed in a storage/carrying bag (not shown) for transport and/or storage.

As illustrated in FIG. 1, each leg tube 18 and 20 includes a foot 54 at the bottom end thereof to stabilize the set-up rocker 10 on any surface, such as grass, dirt, sand or hard floor.

In accordance with preferred embodiments of the present invention, each frame member—namely, the front leg tubes 18, the rear leg tubes 20, the seat tubes 22 and the back-rest tubes 24—may include means for connecting and securing the frame members in the collapsed and bundled condition of the rocker 10, such as illustrated in co-pending U.S. application Ser. No. 17/648,088, incorporated herein by reference.

An alternate embodiment of the present invention is illustrated in FIGS. 7-10 and shows a stowaway compact rocker 110. The general structure of the chair frame 114 for rocker 110 is the same or similar to the chair frame 14 for the rocker 10 illustrated in FIGS. 1-6 and described above, with modifications to the rocking mechanism. More particularly, the core or central hub 116, as illustrated, comprises an alternate compliant design to impart rocking motion to the rocker 110. Common components share similar numerical designations.

Similar to the embodiment of FIGS. 2-6, the rocker 110 utilizes a generally horizontally disposed spring plate 142 connected between a lower transverse support member 128 and an upper transverse support member 126. In the illustrated embodiment, the movable portion is more aligned with the stationary portion, as shown in FIG. 8, with seat tube mounts 136L, 136R in horizontal alignment with respective leg mounts 130L, 130R. This design provides a different range of motion for the movable portion relative to the stationary portion of the chair frame 114.

Another alternate embodiment of the present invention is illustrated in FIG. 11 and shows a stowaway compact rocker 210. The general structure of the chair frame 214 for rocker 210 is the same or similar to the chair frames 14 and 114 of rockers 10 and 110 illustrated in FIGS. 1-6 and 7-10 and described above, with modifications to the rocking mechanism—notably, the arrangement of the spring plate 242 and design of the upper and lower transverse support members 226 and 228. Common components share similar numerical designations.

Another alternate embodiment of the present invention is illustrated in FIGS. 12-17 and shows a stowaway compact rocker 310. The general structure of the chair frame 314 for rocker 310 is the same or similar to the chair frames 14, 114 and 214 of rockers 10, 110 and 210 illustrated in FIGS. 1-6, 7-10 and 11 and described above, with modifications to the rocking mechanism—notably, the use of vertically disposed spring plates 342. Common components share similar numerical designations.

As illustrated, the rocker mechanism comprises linear-flex springs in the form of multiple vertically disposed spring plates 342 spread along the transverse dimension of the chair frame 314. Though multiple plates 342 are shown, as noted above, the design can utilize a singular, centrally-located spring plate without departing from the principles and spirit of the present invention. As further shown, the spring plates 342 can be reinforced to increase rigidity or stability. Still further, the rigidity and flexibility of these spring plates 342 may be adjustable to accommodate users of different weights, or to simply modify the rigidity and flexibility of the compliant members and the rocking capability and motion. An alternate arrangement for the vertically-disposed spring plates 342 is illustrated in FIG. 18.

Figure 14:
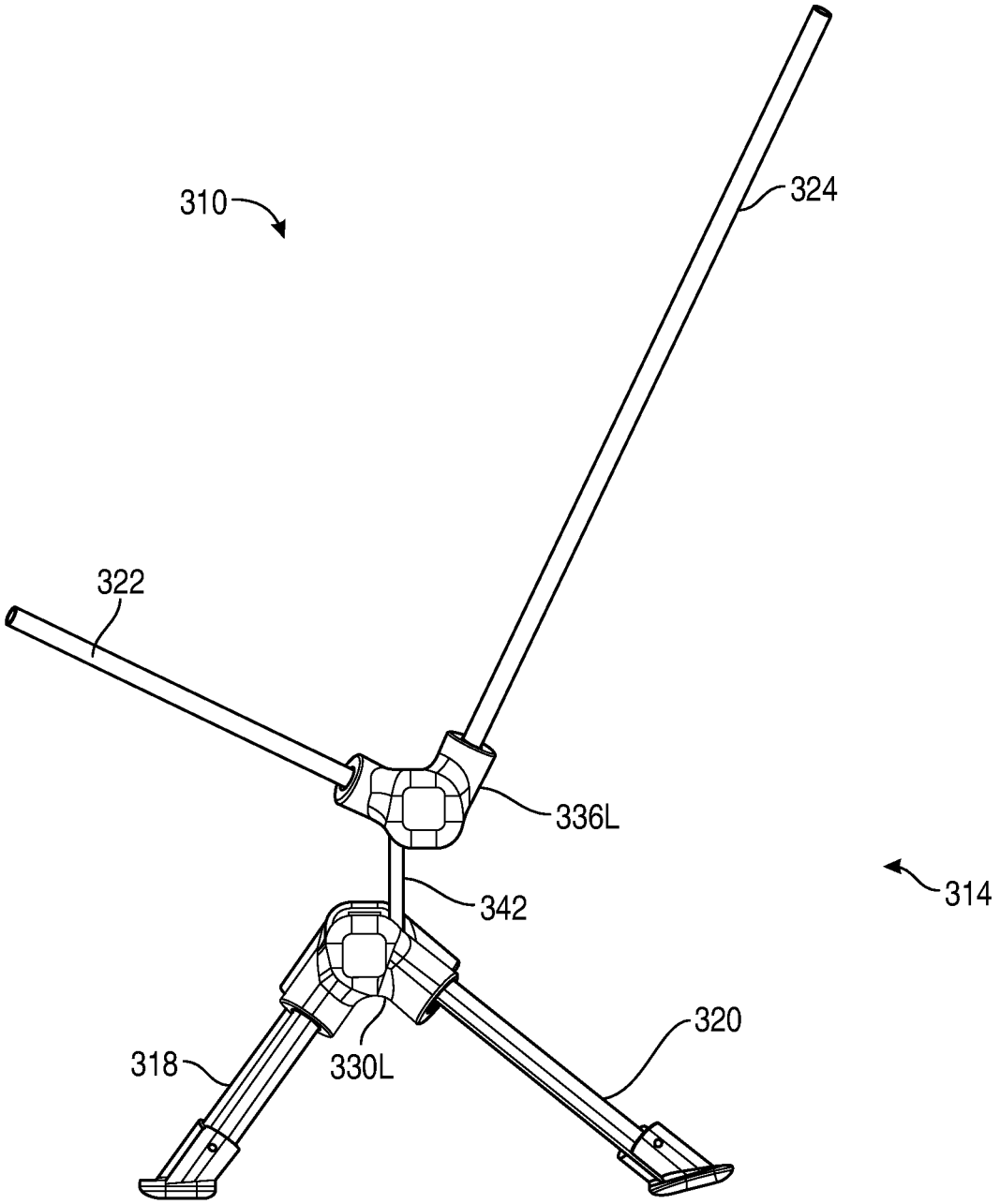
FIG. 14 illustrates a planar side view of the chair frame of FIG. 13.
Figure 15:
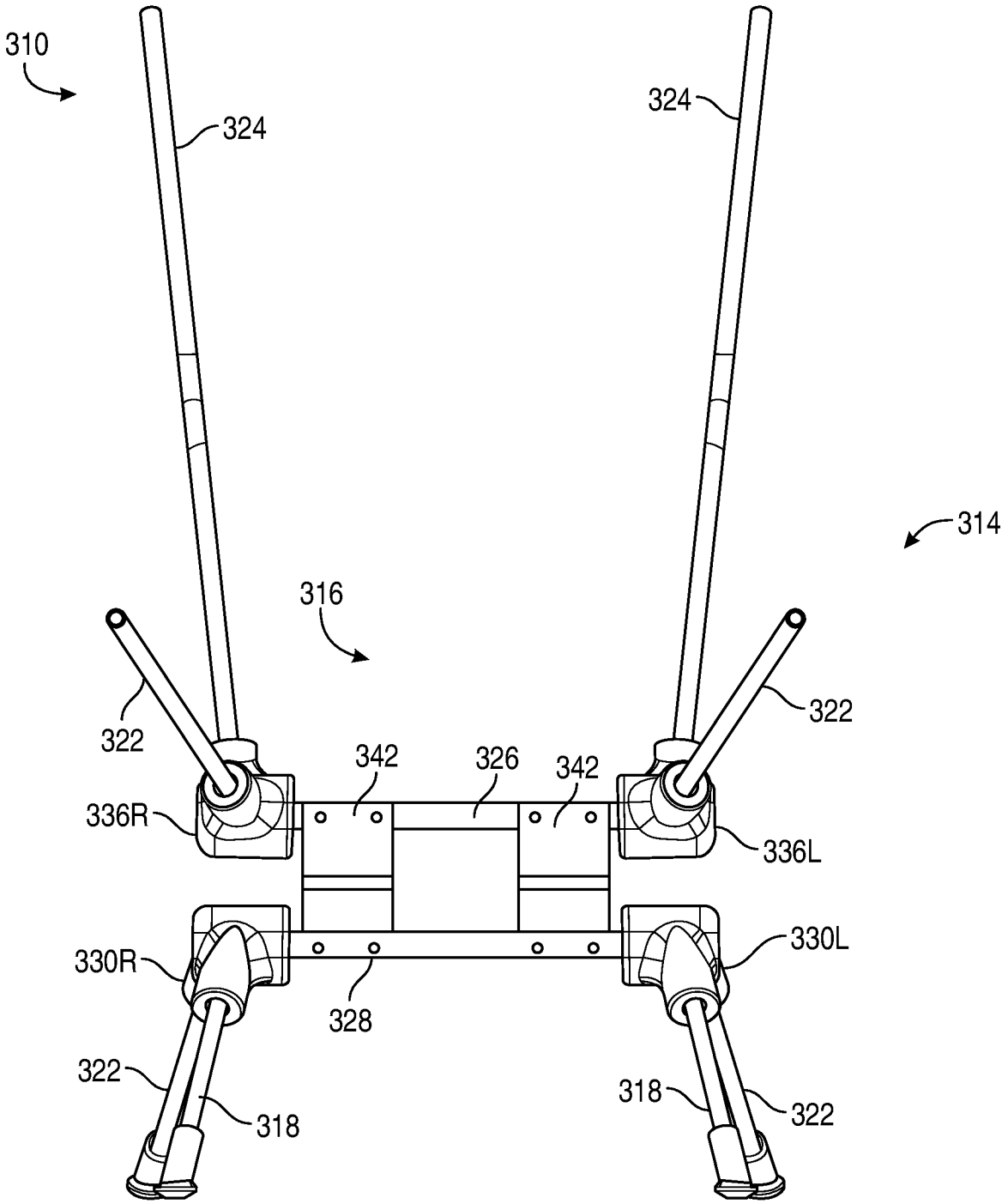
FIG. 15 illustrates a planar front view of the chair frame of FIG. 13.

As with other embodiments shown and described herein, the spring plates 342 are connected between a lower transverse support member 328 belonging to a stationary portion of the chair frame 314 and an upper transverse support member 326 belonging to a movable portion of the chair frame 314. Referring to FIG. 14, the seat tube mounts 336L, 336R are slightly offset from the leg mounts 330L, 330R to accommodate the flexing imparted to the spring plates 342 by a seated user. In use, a spring force is provided by flexing the compliant rocking mechanism, such as by bending the spring plates 342 by a user's force on the chair frame 314. Thus, the movable seating chair frame 314 is adapted for movement relative to the stationary chair frame base when a pressure is applied to at least one of the chair seat and the chair back-rest by the seated user.

As previously noted, the compliant spring plate used to impart rocking capability between the movable portion and the stationary portion of the chair frame of the present invention may be horizontally disposed, as illustrated in the embodiments of FIGS. 2-11, vertically disposed, as illustrated in the embodiment of FIGS. 12-18, or disposed at any other angle between the upper transverse support member and the lower transverse support member, without departing from the principles and spirit of the present invention.

Figure 16:
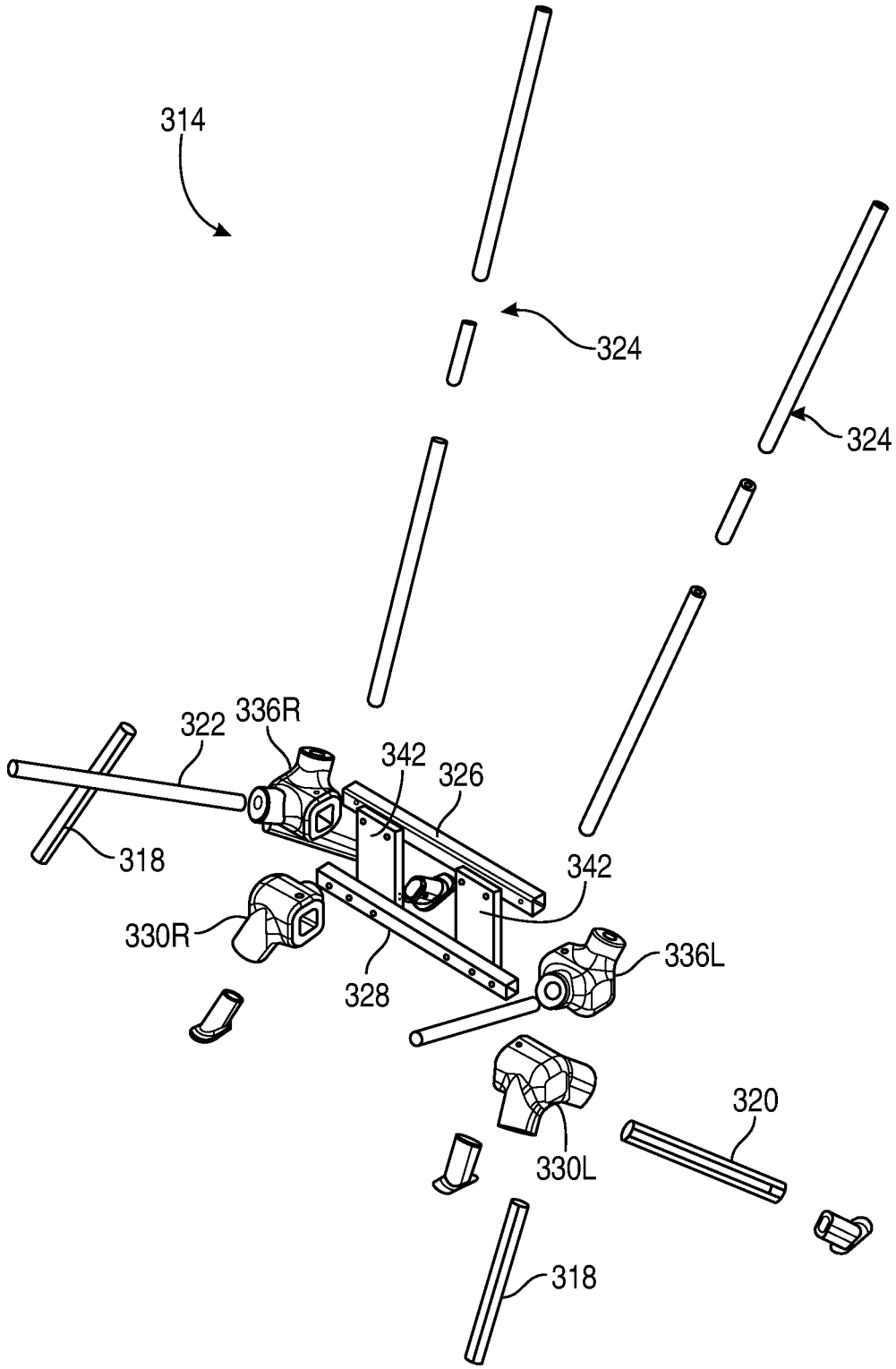
FIG. 16 illustrates an exploded perspective view of the chair frame of FIG. 13.
Figure 17:
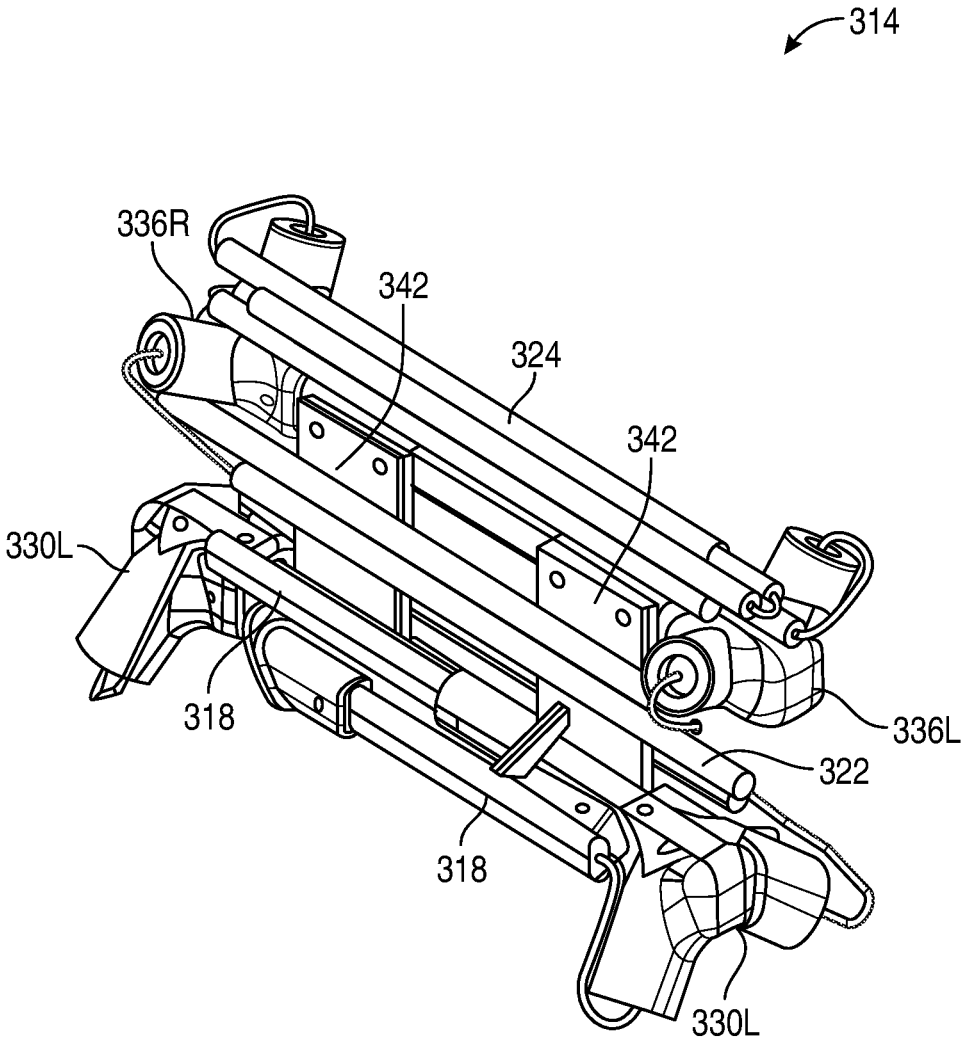
FIG. 17 illustrates a perspective view of the chair frame of FIG. 12 in a collapsed condition.
Figure 18:
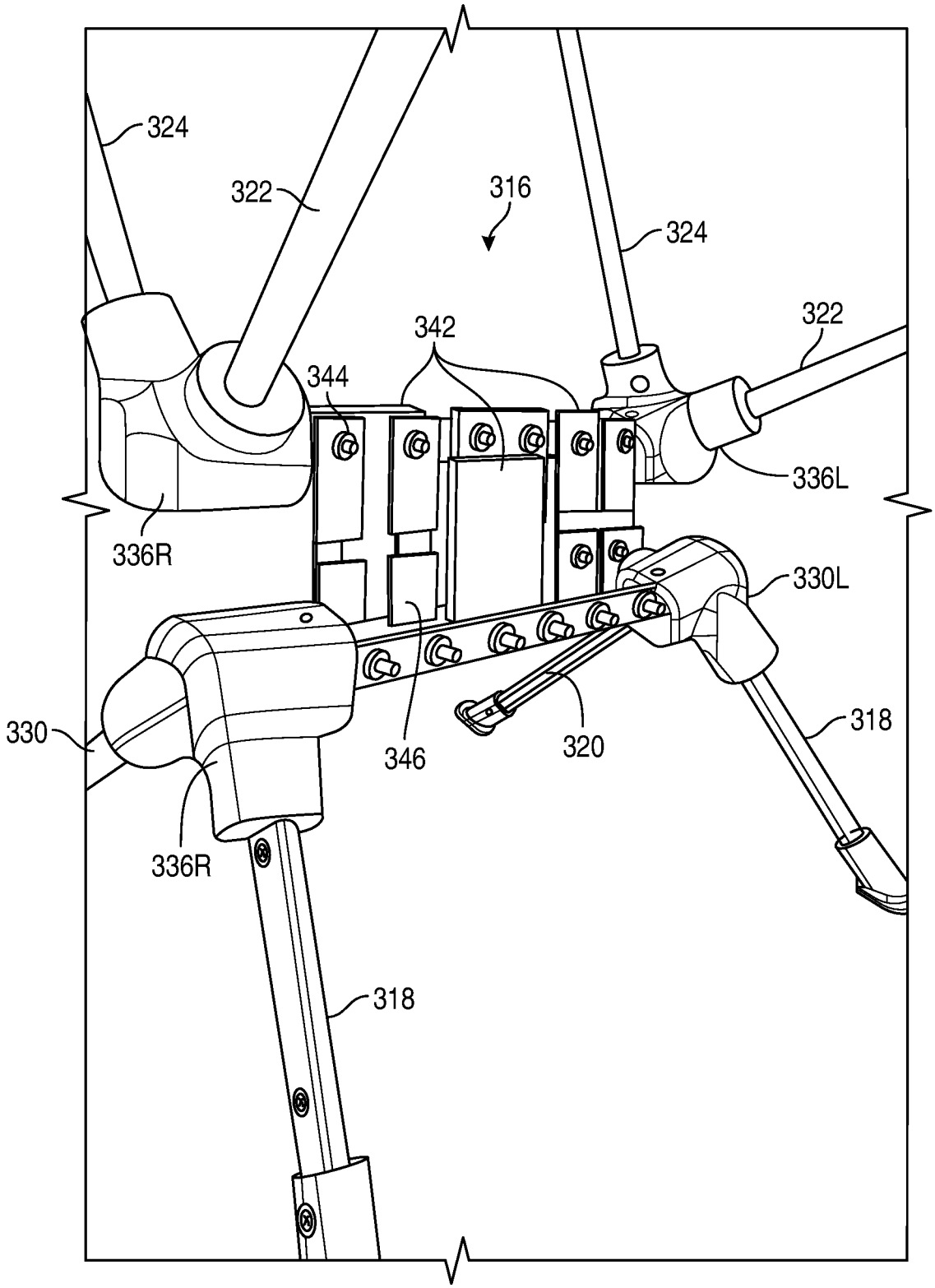
FIG. 18 illustrates a partial rear perspective view of an alternate chair frame design for the stowaway compact rocker of FIG. 12.

When the rocker 310 is not needed, the rocker 310 can be collapsed into a collapsed condition, as illustrated in FIG. 17, by first removing the seating fabric 312, and then disengaging the tube members 318, 320, 322 and 324 from the central hub 316, much in the same manner as illustrated in FIG. 16.

In embodiments of the present invention, the rocking capability for the stowaway compact rocker could be adjustable to change the rigidity and flexibility of the rocking mechanism to accommodate different user weights and/or varied preferences of seated users. Additionally, embodiments may provide an adjustable rocking mechanism so that the rocking capability and comfort level can be optimized to the user's desires, said rocking mechanism comprising compliant members, such as plate springs, linear-flex springs, cantilever springs, leaf springs, torsion springs or the like.

Alternative compliant members may also be used to impart the rocking motion between the movable and stationary portions of the central hub. For example, leaf springs or flexible tension springs of various design can be used in a similar manner to the plate or linear flex springs shown and described herein.

The images and description of embodiments herein generally illustrate a stowaway compact rocker with front-to-back rocking motion. Notably, the present invention also has utility providing side-to-side rocking motion, such as for a pack seat concept or a baby cradle or bassinet, without departing from the principles and spirit of the present invention. Such alternate designs would utilize the general concepts described herein, namely a central hub design having a stationary portion and a movable portion, wherein said central hub would extending front-to-back instead of transversely, and more preferably utilize the plate and linear flex springs relatively positioned between upper and lower support members extending front-to-back so that the seat or cradle portion will rock side-to-side.

In an alternate embodiment of the stowaway compact rocker in accordance with the present invention, a storage/carrying bag can be provided to hold the collapsed and bundled rocker, such as illustrated in FIGS. 6 and 17, for storage and/or transportation. This bag can be provided with an opening along its length for inserting the collapsed and bundled rocker. When the rocker is set-up, the bag can be placed over the top of the back-rest. In embodiments, the bag includes a pillow projecting on the outer surface of the bag, and when the bag is placed over the top of the back-rest, the bag/pillow provides a pillow for the seated user. In alternate designs, the pillow can be a padded projection or a foam sewn into the sidewall of the bag. Still further, the pillow can be a foam insert removably provided in a pocket formed on the bag, or a pocket with an inflatable bladder, so that the bag can be smaller when in storage/carrying bag mode as opposed to pillow mode.

Still further, use of the bag over the top of the back-rest can provide stability to the set-up rocker. As noted, a headrest brace can be used, but is not necessary. Instead, the carrying bag can act as the headrest brace, and in this regard, can include a reinforcing member (such as a sewn-in brace member) to improve stability of the set-up chair.

Additionally, the storage/carrying bag can include additional storage pockets for holding personal effects when using the set-up chair with the bag placed over the top of the back-rest.

The foregoing description of embodiments of the present invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular uses contemplated.

What is claimed is:

1. A stowaway compact rocker having a set-up condition and a collapsed condition, and further having rocking capability when in the set-up condition, said rocker comprising:

a stationary chair frame base comprising:

a lower transverse support member;

a pair of leg mounts disposed at opposing longitudinal ends of the lower transverse support member;

a pair of front leg tubes, each of said front leg tubes being adapted for connection to a respective one of the leg mounts; and a pair of rear legs tubes, each of said rear leg tubes being adapted for connection to a respective one of the leg mounts;

a movable chair frame seating assembly adapted for rocking movement relative to the stationary chair frame base comprising:

an upper transverse support member;

a pair of seat tube mounts disposed at opposing longitudinal ends of the upper transverse support member;

a pair of seat member tubes, each of said seat member tubes being adapted for connection to a respective one of the seat tube mounts; and a pair of back-rest member tubes, each of said back-rest member tubes being adapted for connection to a respective one of the seat tube mounts;

a spring plate connected between the lower transverse support member and the upper transverse support member; and a seating fabric removably mounted to the seat member tubes and the back-rest member tubes in the set-up condition of the rocker and defining a chair seat and a chair back-rest adapted to receive a seated user in the set-up rocker;

wherein the movable chair frame seating assembly is adapted for movement relative to the stationary chair frame base when a pressure is applied to at least one of the chair seat and the chair back-rest by a seated user.

2. The stowaway compact rocker according to claim 1, wherein the front and rear leg tubes are connected to the leg mounts in the set-up condition of the rocker and said front and rear leg tubes are removed from the leg mounts in the collapsed condition of the rocker; and wherein the seat member tubes and back-rest member tubes are connected to the seat tube mounts in the set-up condition of the rocker and said seat member tubes and back-rest member tubes are removed from the seat tube mounts in the collapsed condition of the rocker.

3. The stowaway compact rocker according to claim 2, wherein the front leg tubes, rear leg tubes, seat member tubes and back-rest member tubes are shock-corded to remain connected to the rocker even when in the collapsed condition of the rocker.

4. The stowaway compact rocker according to claim 1, wherein each of the lower transverse support member and the upper transverse support member has a unitary arched construction.

5. The stowaway compact rocker according to claim 1, wherein the spring plate comprises first and second ends, each end secured to one of the lower and upper transverse support members.

6. The stowaway compact rocker according to claim 1, wherein each seat tube mount is horizontally aligned with a respective leg mount.

7. The stowaway compact rocker according to claim 1, wherein each seat tube mount is horizontally offset from a respective leg mount.

8. The stowaway compact rocker according to claim 1, wherein the spring plate is horizontally disposed between the upper transverse support member and the lower transverse support member.

9. The stowaway compact rocker according to claim 1, wherein the spring plate is vertically disposed between the upper transverse support member and the lower transverse support member.

10. A stowaway compact rocker having a set-up condition and a collapsed condition, and further having rocking capability when in the set-up condition, said rocker comprising:

a stationary chair frame base comprising:

a lower transverse support member;

a pair of leg mounts disposed at opposing longitudinal ends of the lower transverse support member;

a pair of front leg tubes, each of said front leg tubes being adapted for connection to a respective one of the leg mounts; and a pair of rear legs tubes, each of said rear leg tubes being adapted for connection to a respective one of the leg mounts;

a movable chair frame seating assembly adapted for rocking movement relative to the stationary chair frame base comprising:

an upper transverse support member;

a pair of seat tube mounts disposed at opposing longitudinal ends of the upper transverse support member;

a pair of seat member tubes, each of said seat member tubes being adapted for connection to a respective one of the seat tube mounts; and a pair of back-rest member tubes, each of said back-rest member tubes being adapted for connection to a respective one of the seat tube mounts;

a rocker mechanism operatively connected between the stationary chair frame base and the movable chair frame seating assembly; and a seating fabric removably mounted to the seat member tubes and the back-rest member tubes in the set-up condition of the rocker and defining a chair seat and a chair back-rest adapted to receive a seated user in the set-up rocker;

wherein the movable chair frame seating assembly is adapted for movement relative to the stationary chair frame base when a pressure is applied to at least one of the chair seat and the chair back-rest by a seated user.

11. The stowaway compact rocker according to claim 10, wherein the rocker mechanism comprises a spring connected between the lower transverse support member and the upper transverse support member.

12. The stowaway compact rocker according to claim 11, wherein the spring comprises a linear-flex spring.

13. The stowaway compact rocker according to claim 11, wherein the spring comprises a cantilevered plate connected between the lower and upper transverse support members and disposed in a generally horizontal plane at a state of rest.

14. The stowaway compact rocker according to claim 13, wherein the cantilevered plate includes spacers on each longitudinal end thereof at the point of connection with the lower and upper transverse support members to define a gap between the stationary chair frame base and the moveable chair frame seating assembly in the set-up condition of the rocker.

15. The stowaway compact rocker according to claim 11, wherein the spring comprises a cantilevered plate connected between the lower and upper transverse support members and disposed in a generally vertical plane at a state of rest.

16. The stowaway compact rocker according to claim 10, wherein the front and rear leg tubes are connected to the leg mounts in the set-up condition of the rocker and said front and rear leg tubes are removed from the leg mounts in the collapsed condition of the rocker; and wherein the seat member tubes and back-rest member tubes are connected to the seat tube mounts in the set-up condition of the rocker and said seat member tubes and back-rest member tubes are removed from the seat tube mounts in the collapsed condition of the rocker.

17. The stowaway compact rocker according to claim 15, wherein the front leg tubes, rear leg tubes, seat member tubes and back-rest member tubes are shock-corded to remain connected to the rocker even when in the collapsed condition of the rocker.

18. The stowaway compact rocker according to claim 10, wherein each of the lower transverse support member and the upper transverse support member has a unitary arched construction.

19. The stowaway compact rocker according to claim 10, wherein the spring plate comprises first and second ends, each end secured to one of the lower and upper transverse support members.

20. The stowaway compact rocker according to claim 10, where each seat tube mount is horizontally aligned with a respective leg mount.

21. The stowaway compact rocker according to claim 10, wherein each seat tube mount is horizontally offset from a respective leg mount.

* * * * *